US007622238B2

(12) United States Patent
Uematsu et al.

(10) Patent No.: US 7,622,238 B2
(45) Date of Patent: Nov. 24, 2009

(54) PROCESS FOR PRODUCING ELECTROPHOTOGRAPHIC PHOTOSENSITIVE MEMBER

(75) Inventors: Hiroki Uematsu, Suntoh-gun (JP); Akira Shimada, Suntoh-gun (JP); Masataka Kawahara, Mishima (JP); Harunobu Ogaki, Suntoh-gun (JP); Atsushi Ochi, Numazu (JP); Akio Maruyama, Tokyo (JP); Kyoichi Teramoto, Abiko (JP); Toshihiro Kikuchi, Yokohama (JP); Akio Koganei, Ichikawa (JP); Takayuki Sumida, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 186 days.

(21) Appl. No.: 11/770,092

(22) Filed: Jun. 28, 2007

(65) Prior Publication Data

US 2007/0281239 A1 Dec. 6, 2007

Related U.S. Application Data

(63) Continuation of application No. PCT/JP2007/051886, filed on Jan. 30, 2007.

(30) Foreign Application Priority Data

Jan. 31, 2006 (JP) ..... 2006-022896
Jan. 31, 2006 (JP) ..... 2006-022898
Jan. 31, 2006 (JP) ..... 2006-022899
Jan. 26, 2007 (JP) ..... 2007-016218

(51) Int. Cl.
*G03G 5/00* (2006.01)

(52) U.S. Cl. ..... 430/130; 430/133

(58) Field of Classification Search ..... 430/133, 430/56, 66, 130
See application file for complete search history.

(56) References Cited

U.S. PATENT DOCUMENTS

| | | | | |
|---|---|---|---|---|
| 6,829,050 | B2 | 12/2004 | Ikeda et al. | 356/400 |
| 7,186,489 | B2 | 3/2007 | Uematsu et al. | 430/66 |
| 2005/0113230 | A1 | 5/2005 | Hirasawa et al. | 492/53 |

FOREIGN PATENT DOCUMENTS

| | | |
|---|---|---|
| JP | 52-026226 | 2/1977 |
| JP | 53-092133 | 8/1978 |
| JP | 57-094772 | 6/1982 |
| JP | 02-150850 | 6/1990 |

(Continued)

OTHER PUBLICATIONS

Translation of IPER dated Aug. 14, 2008 on PCT/JP2007/051886.

*Primary Examiner*—John L Goodrow
(74) *Attorney, Agent, or Firm*—Fitzpatrick, Cella, Harper & Scinto

(57) ABSTRACT

A process for producing an electrophotographic photosensitive member, which has the step of bringing i) the surface of an electrophotographic photosensitive member having at least a charge transport layer on a cylindrical support and ii) a mold having a fine unevenness surface profile into pressure contact with each other to transfer the fine unevenness surface profile to the surface of the electrophotographic photosensitive member. The mold and the support are so temperature-controlled as to be T3<T1<T2 where the glass transition temperature of the charge transport layer is represented by T1 (°C.), the temperature of the mold by T2 (°C.), and the temperature of the support by T3 (°C.).

6 Claims, 10 Drawing Sheets

FOREIGN PATENT DOCUMENTS

| | | |
|---|---|---|
| JP | 08-118469 | 5/1996 |
| JP | 10-104988 | 4/1998 |
| JP | 11-207913 | 8/1999 |
| JP | 2001-066814 | 3/2001 |
| JP | 2002-214414 | 7/2002 |
| JP | 2002-251801 | 9/2002 |
| JP | 2002-258017 | 9/2002 |
| JP | 2004-288784 | 10/2004 |
| JP | 2005-173558 | 6/2005 |
| JP | 2005-199455 | 7/2005 |
| JP | 2006-001050 | 1/2006 |
| JP | 2006-011047 | 1/2006 |

PROCESS FOR PRODUCING ELECTROPHOTOGRAPHIC PHOTOSENSITIVE MEMBER

This application is a continuation of International Application No. PCT/JP2007/051886 filed on Jan. 30, 2007, which claims the benefit of Japanese Patent Application Nos. 2006-022896, filed Jan. 31, 2006, 2006-022898, filed Jan. 31, 2006, 2006-022899, filed Jan. 31, 2006, and 2007-016218, filed Jan. 26, 2007.

BACKGROUND OF THE INVENTION

1. Field of the Invention

This invention relates to a process for producing an electrophotographic photosensitive member, and more particularly to a method of controlling the surface profile of an electrophotographic photosensitive member so as to obtain an electrophotographic photosensitive member having a good cleaning performance.

2. Description of the Related Art

As an electrophotographic photosensitive member, in view of advantages of low prices and high productivity, an organic electrophotographic photosensitive member has become popular, which is an electrophotographic photosensitive member having a support and provided thereon a photosensitive layer (organic photosensitive layer) making use of organic materials as photoconductive materials (such as a charge generating material and a charge transporting material). As the organic electrophotographic photosensitive member, in view of advantages such as a high sensitivity and a variety for material designing, an electrophotographic photosensitive member is prevalent which has a multi-layer type photosensitive layer having a charge generation layer containing a charge generating material and a charge transport layer containing a charge transporting material; the layers being superposed to form the photosensitive layer. The charge generating material may include photoconductive dyes and photoconductive pigments. The charge transporting material may include photoconductive polymers and photoconductive low-molecular weight compounds.

The electrophotographic photosensitive member is, in its image formation process, used under a repeated cycle of charging, exposure, development, transfer, cleaning and charge elimination. Especially in the cleaning step which removes toners remaining on the electrophotographic photosensitive member after the transfer step is an important step in order to obtain sharp images. As a method for this cleaning, what is common is a method in which a rubbery cleaning blade is brought into pressure contact with the electrophotographic photosensitive member to scrape off the toners.

However, a cleaning blade showing a good cleaning performance has so large frictional force as to tend to cause problems such as an increase in drive torque, slip-away of toners because of a very small vibration of the cleaning blade and further turn-over of the cleaning blade. In recent years, it is also taken as a problem that the cleaning performance is affected by toners having been made small-diameter and high-function taking account of a trend toward higher image quality.

As a method of overcoming the above problems, a method is proposed in which the area of contact between the photosensitive member surface and the cleaning blade is made small by roughening the photosensitive member surface appropriately, to lower the frictional force between them. For example, a method is disclosed in which drying conditions set when the photosensitive layer is formed are controlled to roughen the photosensitive layer surface in orange peel surface (see, e.g., Japanese Patent Application Laid-open No. S53-092133). This method has an advantage that any special investment for installation is basically unnecessary because the surface is roughened in a usual photosensitive layer formation step. On the other hand, this method is disadvantageous in that it requires many factors for control, such as the temperature, humidity and time to be set in drying, the uniformity of atmosphere, the type of solvents, and so forth.

A method is also known in which powder particles are previously added to the surface layer to provide a rough surface (see, e.g., Japanese Patent Application Laid-open No. S52-026226). However, in general, where a powder is added to the photosensitive member, only a few powders are available which are suited for photosensitive members in respect of the materials, dispersibility and liquid stability of powders. Moreover, such powder may adversely affect properties of photosensitive members depending on the amount of its addition, and hence there is not so high a degree of freedom for the addition of powder. This method also has a disadvantage that desired surface properties are achievable with difficulty because of the leveling effect that comes at the time of coating.

Against such surface roughening in the coating step, as a method by which the surface profile can more readily be controlled, e.g., as a mechanical surface roughening method, a method is disclosed in which the photosensitive member surface is polished by using a wire brush made of a metal (see, e.g., Japanese Patent Application Laid-open No. S57-094772). This method has a difficulty that, when the brush is continuously used, it is difficult to achieve its reproducibility because brush bristle ends may deteriorate or polish dust may adhere to the bristle ends.

As another mechanically surface-roughening method, a method is available in which the photosensitive member surface is polished with a filmy polishing material (see, e.g., Japanese Patent Application Laid-open No. H02-150850). In this method, a fresh surface of the filmy polishing material can always be used in the polishing in virtue of a film wind-up unit. This enables achievement of reproducibility of the surface-roughening. Although the filmy polishing material has a disadvantage that it involves a high cost, this method has hitherto been considered to be a simple and effective method. However, abrasion dust of the photosensitive layer because of the polishing of, i.e., mechanical destruction of the photosensitive layer surface, and also the film-origin polishing material, may come into question.

As still another mechanically surface-roughening method, a method is disclosed in which the peripheral surface of an electrophotographic photosensitive member is roughened by blasting (see, e.g., Japanese Patent Application Laid-open No. H02-150850). This method has an advantage that the size and type of abrasive grains and blasting conditions may be controlled to enable control of surface profile to a certain extent, but on the other hand may come into question from the viewpoint of productivity and cost.

More specifically, in the background art, the surfaces of electrophotographic photosensitive members can be roughened to a certain extent, and this has brought certain effects. However, under existing circumstances, how to process surface profile more finely and in a more controlled state has not been established toward further improvements in performance and productivity.

Meanwhile, against the foregoing mechanically surface-roughening method, as a method by which the surface profile can more finely be controlled in a non-destructive way, a method is disclosed in which a touch roll or stamper (stamping die) having an unevenness profile on its surface is brought into contact with the surface of an electrophotographic photosensitive member to carry out compression forming (see, e.g., Japanese Patent Application Laid-open No. 2001-066814). According to this patent publication, a touch roll made of SUS304 stainless steel and having a prismatic and wavy surface profile is brought into contact with an electrophotographic photosensitive member at a pressure of $2\times10^{-4}$ N to form on the surface of the electrophotographic photosensitive member a wavy profile of, e.g., 5 μm in average pitch and 5 μm in average depth. Such a working example is disclosed therein. A working example is also disclosed in which a stamper on which a well type surface profile of 100 nm in average length per one side and 100 nm in average depth is formed at a pitch-to-pitch distance of 100 nm is used to process the surface of an electrophotographic photosensitive member by compression forming for 2 minutes at a pressure of 0.8 N. As the result, a well type surface profile of 70 nm in average length per one side and 30 nm in depth has been formed on the surface of the electrophotographic photosensitive member at a pitch-to-pitch distance of 120 nm, as so disclosed. It is also disclosed that the forming precision can be improved by heating the electrophotographic photosensitive member and the stamper at the time of such surface processing and that the surface processing pressure is set at 1 N or less in order to maintain the roundness of the electrophotographic photosensitive member.

Such a compression forming technique is a technique in which an embossing technique which is a method for the unevenness processing of the surfaces of resin products or the like as conventionally known in the art, or a nano-imprinting technique on which researches are energetically forwarded in recent years as a fine surface processing technique, is applied to electrophotographic photosensitive members.

In general, such conventional techniques in which the surfaces of resin films or molded resin products are subjected to unevenness surface processing are carried out through the following steps (see, e.g., Japanese Patent Application Laid-open No. 2004-288784).

(1) A resin product to be surface-processed is heated to glass transition temperature or higher temperature of the resin (the step of softening the resin so as to be readily thermally deformed); (2) a stamper (stamping die) is heated to glass transition temperature or higher temperature of the resin and this is brought into pressure contact with the resin (the step of making the resin enter the interior of a fine surface profile of the stamper); (3) after lapse of a stated period of time, the resin and the stamper are cooled to their glass transition temperature or lower temperature (the step of fixing the fine surface profile); and (4) the stamper is separated from the resin product.

The foregoing steps enable batch transfer of fine surface profiles in accordance with the area of the stamper, and various surface processing objects can individually be processed according to the steps (a batch system). In the case of sheet-like surface processing objects, surface profiles corresponding to the area of the stamper can repeatedly be transferred while the processing objects are moved (a step-and-repeat system). The steps of heating and cooling are very important in the above steps. If the heating is carried out at a low temperature, the surface profile may insufficiently be transferred. If the cooling is insufficiently carried out, the surface profile having been transferred may come out of shape. Such problems tend to arise, and hence detailed optimization is required in accordance with various properties of the resin.

Moreover, surface processing non-uniformity may come about because of non-uniform pressure and temperature within the area of the stamper, or it is necessary to apply pressure over the whole area of the stamper. Hence, under existing circumstances, there remain problems on apparatus construction because the pressure used must set high and also the steps of heating and cooling must be repeated and further productivity is poor. Accordingly, various measures and improvements have been attempted in order to solve such problems.

In addition, the surface processing objects are commonly supposed to be made of flat-platelike or flexible materials, whereas a surface processing object like a cylindrical electrophotographic photosensitive member in the present invention, having a curvature and requiring the surface processing of a several microns to tens of microns thick resin layer formed on a support having a small elastic deformation level and having a hardness, is difficult to process in a good precision for the contact between its surface and the stamper. Thus, it is supposed to be very difficult to attain the surface processing uniformity from the viewpoint of pressure uniformity within the area.

From the foregoing, under existing circumstances, there are many problems in the surface processing of cylindrical electrophotographic photosensitive members by the batch system and the step-and-repeat system.

Meanwhile, as a method in which the surface of a surface processing object is continuously unevenness-processed while the processing object is moved, a surface processing method of producing an embossed sheet is disclosed (see, e.g., Japanese Patent Applications Laid-open No. H08-118469 and No. H11-207913). In this method, it is common that, first, a processing object resin sheet is kept heated and softened, and this is continuously inserted and pressured between a pressure roll and a pattern roll (embossing roll) to transfer the latter's surface profile to the sheet, followed by the step of cooling to obtain an embossed article (a roll system). Here, it is usual to provide a temperature-conditioning mechanism between the pressure roll and the pattern roll to cool the sheet for the profile transfer by pressuring and simultaneously for the profile fixing. This method enables processing objects to be embossed continuously and in a good productivity along a series of the above flows, and is useful as a method for the surface profile processing chiefly on a film of tens of microns or more in thickness.

Here, in an attempt to employ the above surface processing method as a method of embossing the cylindrical electrophotographic photosensitive member with a stated surface profile on its peripheral surface, the following problem may arise. That is, the surface of the cylindrical electrophotographic photosensitive member is constituted of a continuous peripheral surface. Hence, in an attempt to process the whole peripheral surface, the region having been processed first may reach the vicinity of a nip formed by the pressure roll and the pattern roll, at a point of time where the surface processing is finally completed. As the result, it follows that the region having first been embossed with the surface profile is again heated, so that the surface profile may come out of shape. It is also very difficult that the heating and cooling at forward and backward zones, respectively, of the pressure surface processing region are temperature-controlled on such a continuous thin resin film formed on the support. Hence, this is considered not practical.

Further, as another method of continuously surface processing an object while it is moved, a production method is disclosed which is carried out by roll embossing, intended for unevenness micropattern surface processing of optical devices (see, e.g., Japanese Patent Application Laid-open No. 2002-214414). According to this method, a three-dimensional profile can be transferred in a good precision, to a thin resin film formed on a substrate, as so disclosed. Stated specifically, a flat platelike processing object is placed on a movable transfer stage, and the stage is moved while a roll-shaped forming material having a micropattern on its surface is pressured, whereby the surface profile is continuously transferred to the thin resin film formed on the substrate. It is described that the transfer stage and the roll-shaped forming material may be heated or a heater may be placed at backward and forward zones of pressuring so that the thin resin film can be heated and softened, to thereby improve pattern forming performance. Here, in the cylindrical electrophotographic photosensitive member in the present invention, in an attempt to employ the above surface processing method so as to process the whole peripheral surface uniformly and continuously, the following problems arise.

In such a case, a support which corresponds to the substrate and a photosensitive layer and a protective layer which correspond to thin resin films formed on the substrate are always heated by an external means. More specifically, as the problem has come about when the surface processing method of producing an embossed sheet is employed, the problem that a surface profile having been transferred first comes out of shape may arise because the regions before surface processing and after surface processing stand continuous. Especially where the transfer of a surface profile to the photosensitive layer used in the electrophotographic photosensitive member is taken into account, the problem that the surface profile may come out of shape tends to arise more remarkably in view of the fact that the layer contains a charge-transporting material in a large quantity, compared with common thermoplastic resins.

As discussed above, the employment of the compression forming techniques in electrophotographic photosensitive members is supposed to be very useful, but any production method therefor has not sufficiently been established, and, under existing circumstances, there remains room for further improvement.

SUMMARY OF THE INVENTION

Problems of the Invention Intends to Solve

We the inventors have made studies in detail on how to control fine profiles of the surfaces of electrophotographic photosensitive members in a high precision. In making such studies, on the basis of standpoints of variety in such profiles, controllability and non-destructive surface processing, studies have been made on a surface processing method in which a mold serving as a profile-providing material having a stated surface profile is brought into pressure contact with the surface of an electrophotographic photosensitive member to transfer a fine unevenness profile to that surface. At first, taking account of the background art inclusive of the aforesaid Japanese Patent Application Laid-open No. 2001-066814, the present inventors have supposed that the transfer of profiles takes place with ease as long as the pressuring force and forming temperature are appropriately set. However, the result has disagreed therewith, where it has become aware that the pressuring force and forming temperature must be controlled more than what has been supposed. In particular, it has become aware how important is the problem of coming out of shape that is due to the temperature applied after pressuring. It has further become aware that optimum conditions for such a surface processing method are required depending on differences in materials, layer configuration and physical properties of electrophotographic photosensitive members.

That is, any surface processing method for the fine control of surface profiles of electrophotographic photosensitive members has not been presented as a satisfactory production process. Further, any production process has not been presented which has taken account of productivity and quality stability.

To optimize the surface profile of the electrophotographic photosensitive member with the aim of improving cleaning performance, the present invention aims to provide a process for producing such an electrophotographic photosensitive member.

Means for Solving the Problems

To study the aforesaid surface processing method in which a mold as a profile-providing material having a stated surface profile is brought into pressure contact with the surface of an electrophotographic photosensitive member to transfer a fine unevenness profile to that surface, the present inventors have discovered that, by precisely controlling the temperatures of the mold and the support of the electrophotographic photosensitive member, a fine unevenness profile can be transferred to the surface of the electrophotographic photosensitive member in a good precision and by a production process having a high productivity. Thus, they have accomplished the present invention.

More specifically, the present invention is a process for producing an electrophotographic photosensitive member; the process having the step of bringing i) the surface of an electrophotographic photosensitive member comprising at least a cylindrical support and a charge transport layer provided thereon and ii) a mold having a fine unevenness surface profile, into pressure contact with each other to transfer the fine unevenness surface profile to the surface of the electrophotographic photosensitive member, wherein; the mold and the cylindrical support are so temperature-controlled as to be $T3<T1<T2$ where the glass transition temperature of the charge transport layer is represented by T1 (° C.), the temperature of the mold by T2 (° C.), and the temperature of the cylindrical support by T3 (° C.).

More preferably, the present invention may be an electrophotographic photosensitive member production process in which the following relationship is maintained: $T1<T4$ where the maximum value of the temperature of the charge transport layer at the part of pressure contact between the surface of the electrophotographic photosensitive member and the mold is represented by T4 (° C.).

The present invention may also be an electrophotographic photosensitive member production process in which the charge transport layer is formed by the following steps i) and ii): i) the step of coating a charge transport layer coating solution containing at least a binder resin and a charge-transporting material, ii) the step of drying the solution, and the following relationship is maintained: $T5<T4$ where the maximum value of the temperature of the charge transport layer in the step ii) is represented by T5 (° C.).

The present invention may further be an electrophotographic photosensitive member production process in which the following relationship is maintained: $T6<T1$ where the maximum value of the temperature of the charge transport layer at the part other than the part of pressure contact between the surface of the electrophotographic photosensitive member and the mold is represented by T6 (° C.).

The present invention may still also be an electrophotographic photosensitive member production process in which the following relationship is maintained: T4<T7 where the melting point of the charge-transporting material is represented by T7 (° C.).

The present invention may further be an electrophotographic photosensitive member production process in which a member having a larger heat capacity than the cylindrical support is inserted to the interior of the cylindrical support.

The present invention may further be an electrophotographic photosensitive member production process in which the member having a larger heat capacity has a mechanism which controls the temperature of the cylindrical support.

The present invention may further be an electrophotographic photosensitive member production process in which the member having a larger heat capacity has a cooling mechanism.

The present invention may further be an electrophotographic photosensitive member production process in which the fine unevenness surface profile is continuously transferred to the surface of the electrophotographic photosensitive member in its peripheral direction.

The present invention may also be a process for producing an electrophotographic photosensitive member having an unevenness profile on the surface thereof, comprising a cylindrical support and a charge transport layer provided thereon, the charge transport layer having a glass transition temperature of T1 (° C.), the process comprising a step of bringing a mold having an unevenness surface profile corresponding to the unevenness profile, and having a temperature of T2 (° C.), into pressure contact with the peripheral surface of an electrophotographic photosensitive member, and rotating at least one of the mold and the electrophotographic photosensitive member to transfer the unevenness surface profile of the mold to the peripheral surface of the electrophotographic photosensitive member; wherein the step is carried out while maintaining the relationship represented by the following inequality: T3<T1<T2 where T3 represents the temperature of the cylindrical support.

According to the present invention, the surface profile of the electrophotographic photosensitive member can be formed in variety and also in a good controllability, and still also by a production process improved in productivity. The electrophotographic photosensitive member produced in this way exhibits a good cleaning performance.

Further features of the present invention will become apparent from the following description of exemplary embodiments with reference to the attached drawings.

DESCRIPTION OF THE EMBODIMENTS

The present invention is described below in detail.

Surface Processing Unit

Figure 1A:
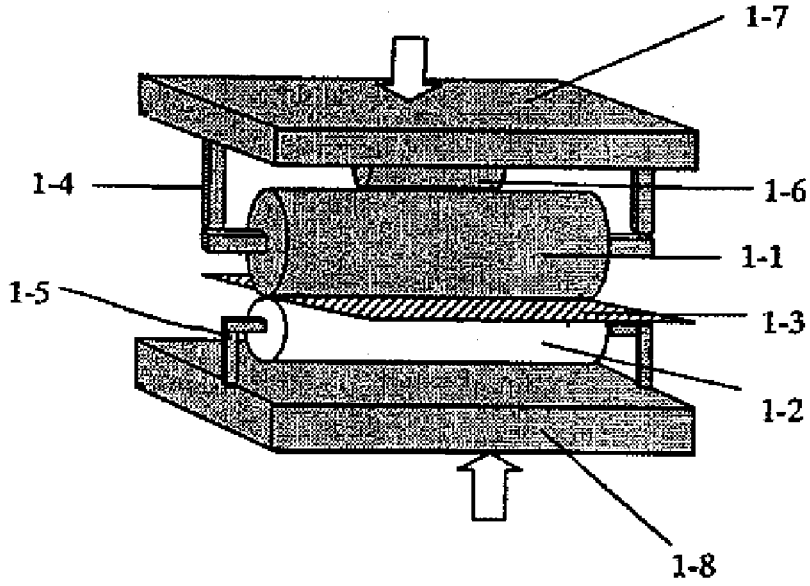
FIG. 1A is a structural view showing an example of a surface profile processing unit in the present invention, as viewed from the front of the unit.
Figure 1B:
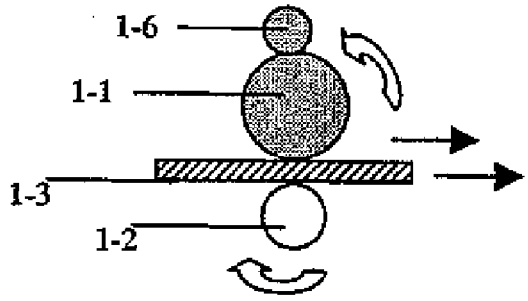
FIG. 1B illustrates the surface profile processing unit shown in FIG. 1A, as viewed from its side.

In the first place, a specific example of the surface profile processing unit used in the present invention is schematically shown in FIGS. 1A and 1B.

In the unit shown in FIGS. 1A and 1B, a mold 1-3 having a stated surface profile is provided between a roll type pressurizing member 1-1 and a cylindrical electrophotographic photosensitive member 1-2. In this unit, the top surface of the mold is continuously pressured while both the pressurizing member 1-1 and the electrophotographic photosensitive member 1-2 are rotated. Thus, the surface profile of the mold is transferred to the peripheral surface of the electrophotographic photosensitive member 1-2.

The roll type pressurizing member 1-1 and the cylindrical electrophotographic photosensitive member 1-2 are held by supporting members 1-4 and 1-5, respectively, and are fastened to base plates 1-7 and 1-8, respectively. Supporting members as right and left fixtures may be fastened onto the same base plates as shown in the drawings, or, as occasion calls, the right and left fixtures may be fastened to respectively independent base plates.

The pressure may be applied from either of the base plates 1-7 and 1-8 or from both of these, and simultaneously the pressurizing member 1-1 and the electrophotographic photosensitive member 1-2 are rotated, whereby the surface profile of the mold 1-3 can be transferred to the peripheral surface of the electrophotographic photosensitive member.

As materials for the pressurizing member, any desired metals, metal oxides, plastics and glass may be used. In particular, SUS stainless steel may preferably be used from the viewpoint of mechanical strength, dimensional precision and durability. The pressurizing member 1-1 (pressure roller) may be in a solid cylindrical shape or a hollow cylindrical shape in accordance with surface processing pressure. The pressurizing member 1-1 is held by the supporting member 1-4. It is brought into contact with the electrophotographic photosensitive member at a stated pressure by a pressuring system (not shown), and is thereafter rotated by drive or by follow-up movement. Pressure balance between right and left sides can be controlled. Where the pressurizing member 1-1 is held by the supporting member 1-4 at the former's right and left both sides as in the present unit example, pressure imbalance may come about between both end portions and the vicinity of the middle portion depending on the surface processing pressure. In such a case, for the purpose of securing pressure uniformity in the lengthwise direction, a back-up roll 1-6 for pressure adjustment may be used in combination, the pressurizing member 1-1 itself may be worked in a crown shape, or furthermore a rubber elastic layer may be provided on the surface layer. The size, number and position of the back-up roll 1-6 may appropriately be adjusted.

Figure 2A:
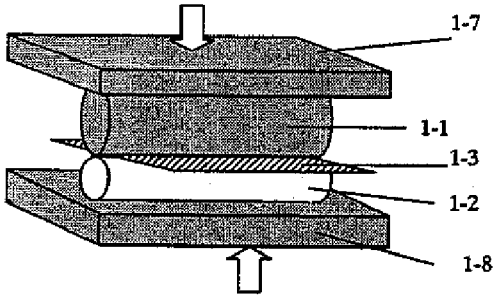
FIG. 2A is a structural view showing another example of the surface profile processing unit in the present invention, as viewed from the front of the unit.
Figure 2B:
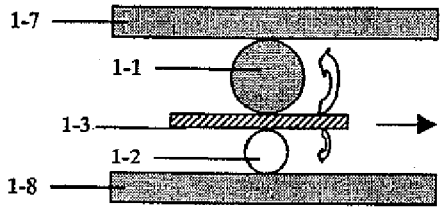
FIG. 2B illustrates the surface profile processing unit shown in FIG. 2A, as viewed from its side.
Figure 2C:
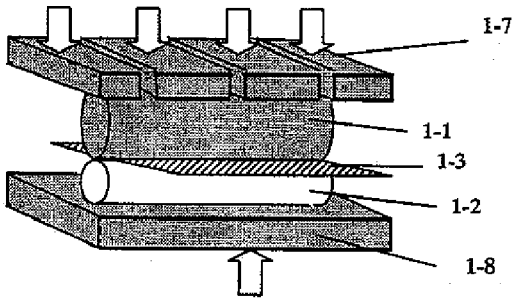
FIG. 2C illustrates a modification of the surface profile processing unit shown in FIG. 2A, as viewed from its front.

Besides the method shown in FIGS. 1A and 1B, part or the whole of the pressurizing member 1-1 and the electrophotographic photosensitive member 1-2 each may directly be pressured in their lengthwise directions, as shown in FIGS. 2A and 2B or FIG. 2C.

Further, for the purpose of eliminating any pressure imbalance in the rotational direction, a mechanism which adjusts the pressure at any time at the time of surface processing may be provided while a pressure monitor making use of a load cell is used in combination.

In the present invention, it is important to control die temperature as described later, in order to optimize the surface processing step. To control the mold temperature, the mold itself may directly be heated or cooled by heating and cooling means provided externally or internally. In particular, the pressurizing member to which the mold is provided may preferably be temperature-controlled to control the temperature of the mold. As methods by which the pressurizing member 1-1 is temperature-controlled, usable are a method in which a heater of various types is provided in the interior of the pressurizing member, and a method in which the pressurizing member is heated from the outside. As the heating means, any known technique may be used, making use of a means such as a ceramic heater, a far infrared radiation heater, a halogen heater, a cartridge heater or an electromagnetic induction heater. As the cooling means, any known technique of water cooling or air cooling may be used. A temperature control unit such as a temperature controller utilizing a thermocouple may also preferably be used in combination to secure the uniformity of temperature. For the purpose of improving pressure uniformity and temperature uniformity, it is preferred for the pressurizing member to have a large diameter as long as there comes no difficulty.

The electrophotographic photosensitive member is held by the supporting member and is rotated by drive or by follow-up movement. The electrophotographic photosensitive member is commonly formed to have a hollow cylindrical support. Where such a support is expected to be deformed because of the surface processing pressure, it is effective to provide through the interior of the cylindrical support a columnar holding guide made of a metal such as SUS stainless steel. For the purpose of eliminating any pressure imbalance, a back-up roll may also be used in combination. However, care must be taken for any scratches and the like which may come about because of its direct contact with the electrophotographic photosensitive member surface, and materials therefor may be selected. A cushioning material such as a rubber or resin material may further be provided between the back-up roll and the electrophotographic photosensitive member surface. Further, like the pressurizing member, a heating means and a cooling means which are of internal or external set-up may be used in combination to make direct temperature control of the electrophotographic photosensitive member itself. The temperature of the holding guide may also be controlled to perform indirect control the temperature of the electrophotographic photosensitive member. Here, for the purpose of improving uniformity and stability of the temperature, it is preferable for the holding guide to have a sufficient heat capacity. As to temperature control of the electrophotographic photosensitive member, it will be described later in detail, inclusive of layer configuration of the electrophotographic photosensitive member. As to how to pressure the electrophotographic photosensitive member against the pressurizing member, the same method as how to pressure the pressurizing member as described previously may be used.

The mold as a profile-providing material is a sheetlike or platelike member which may be flexible and on the surface of which a stated profile has been formed. The mold may be a material including a finely surface processed metal, a glass, resin or silicon wafer the surface of which has been patterned using a resist, a resin film with fine particles dispersed therein, and a resin film having a stated fine surface profile and having been coated with a metal. Commonly, what is in wide use is a silicon wafer on which fine surface profile has been drawn by photolithography or electron ray processing, followed by necessary etching treatment, or a mold obtained by nickel electroforming using as a matrix (master) a resin (such as polyimide) sheet or plate on which a fine surface profile has been drawn by laser processing or the like. In the present unit example, an example is shown in which the mold is inserted between the pressurizing member and the electrophotographic photosensitive member in the shape of a sheet or plate to carry out the surface processing. In the case of the mold having a flexibility, it may be used in the state it is wound around the pressurizing member. Further, the pressurizing member surface itself may finely be surface-processed so as to use itself as the mold.

Figure 3A:
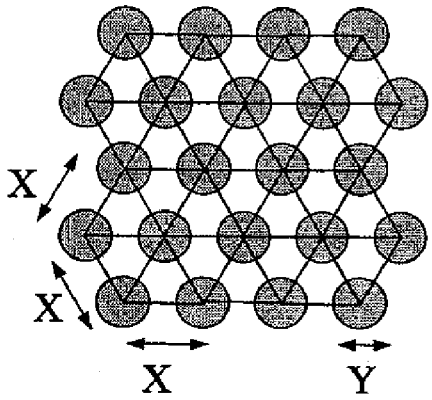
FIG. 3A is a top plan view showing an example of a mold as a profile-providing material in the present invention.
Figure 3B:
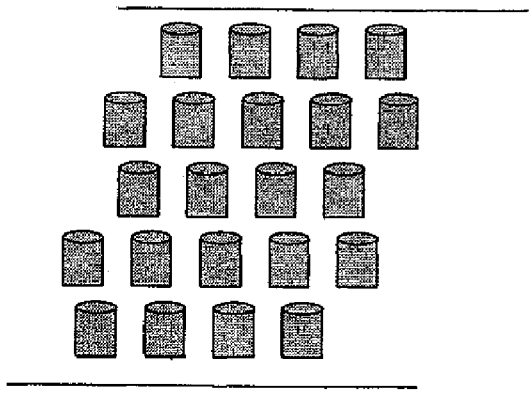
FIG. 3B is a perspective top view showing the mold shown in FIG. 3A.
Figure 3C:
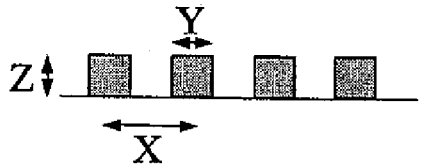
FIG. 3C is a side view showing the mold shown in FIG. 3A.

In FIGS. 3A, 3B and 3C, an example of a mold in which columnar pillars (hills) are independently arranged in a lattice is shown as enlarged views. Diameter Y, height Z and pitch (center-to-center distance) X of the pillars may appropriately be designed. The shape of each pillar (hill) may also freely be designed to have the shape of a column, and besides the shape of a polygonal pillar such as a quadrilateral pillar, a triangular pillar or a hexagonal pillar, the shape of an ellipse pillar, the shape of a hill having gentle curves, or the shape of a microlens array. Those which differ in their arrangement and individual sizes and shapes may mixedly be present. Further, holes (dales) having various shapes may be formed.

As continuous production in the present surface processing unit, what may be contemplated is, e.g., a form in which electrophotographic photosensitive members move successively together with holding members before and after the surface processing, and a form in which the pressurizing member and the holding member are kept fastened on the same axis and in this state electrophotographic photosensitive members are successively placed on and released from the pressurizing member Next, other specific examples of the surface profile processing unit used in the present invention is schematically shown in FIGS. 4A and 4B and FIGS. 4C and 4D.

In each of the units shown in FIGS. 4A and 4B and FIGS. 4C and 4D, a mold 1-3 having a stated surface profile is provided between a flat-plate type pressurizing member 1-1 and an electrophotographic photosensitive member 1-2. According to this unit, the electrophotographic photosensitive member 1-2 is rotated, during which its peripheral surface is continuously pressured. Thus, the surface profile of the mold 1-3 can be transferred to the peripheral surface of the electrophotographic photosensitive member 1-2.

As materials for the pressurizing member, like the pressurizing member shown in FIGS. 1A and 1B, any desired metals, metal oxides, plastics and glass may be used. SUS stainless steel may preferably be used from the viewpoint of mechanical strength, dimensional precision and durability. The pressurizing member may be designed for its size and shape in accordance with the surface processing pressure and surface processing area. The pressurizing member, provided on its top surface with the mold, is brought into contact with the electrophotographic photosensitive member at a stated pressure by a supporting member (not shown) and a pressuring system (not shown) which are provided on the under surface side of the pressurizing member; the electrophotographic photosensitive member being held by a supporting member 1-5. Thus, the surface profile can be transferred. Like the unit example shown in FIGS. 1A and 1B, a method may also be used in which the supporting member holding the electrophotographic photosensitive member is pressed against the pressurizing member to effect pressuring. Further, the both may simultaneously effect pressuring.

Figure 4A:
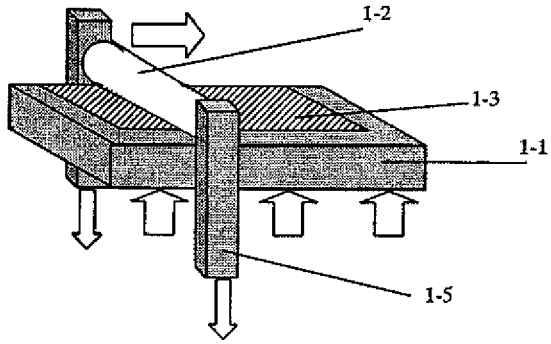
FIG. 4A is a structural view showing still another example of the surface profile processing unit in the present invention, as viewed diagonally from the top of the unit.
Figure 4B:
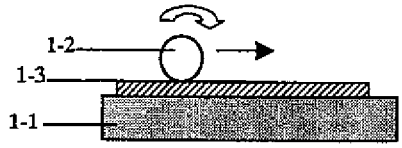
FIG. 4B is a structural view showing the surface profile processing unit shown in FIG. 4A, as viewed from the side of the unit.
Figure 4C:
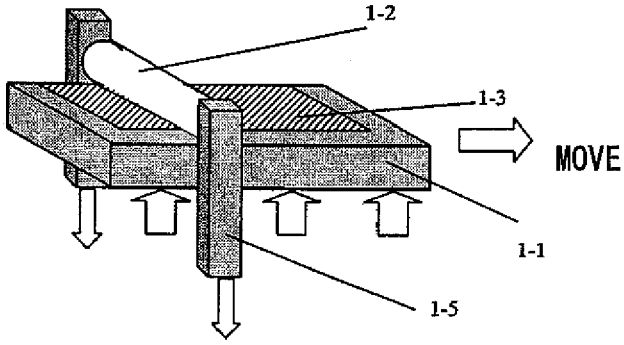
FIG. 4C is a structural view showing a further example of the surface profile processing unit in the present invention, as viewed diagonally from the top of the unit.
Figure 4D:
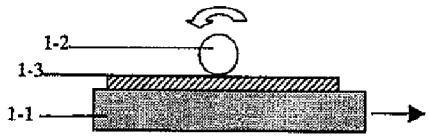
FIG. 4D is a structural view showing the surface profile processing unit shown in FIG. 4C, as viewed from the side of the unit.

In FIGS. 4A and 4B, an example is shown in which the supporting member 1-5 holding the electrophotographic photosensitive member 1-2 is moved to carry out surface processing of the electrophotographic photosensitive member continuously while it is rotated by follow-up movement or by drive. Instead, as shown in FIGS. 4C and 4D, the supporting member 1-5 may be set stationary and the pressurizing member 1-1 may be moved. Also, both the electrophotographic photosensitive member and the pressurizing member may simultaneously be moved.

In these unit examples as well, any pressure imbalance may come about on the electrophotographic photosensitive member in its lengthwise direction and peripheral direction. In such a case, a supporting member (not shown) provided on the under surface side of the pressurizing member may positionally be adjusted or may be supported at a larger number of points, or the shape of the pressurizing member itself may be adjusted by working. Further, the pressurizing member may be provided on its surface with an elastic layer such as a rubber or resin layer. For the purpose of eliminating such pressure imbalance, a mechanism which adjusts the pressure at any time at the time of surface processing may be provided while a pressure monitor making use of a load cell is used in combination. As methods by which the pressurizing member is temperature-controlled, usable are a method in which a heater of various types is provided in the interior of the flat plate, and a method in which the flat plate is heated from the outside, any of which may be selected. For the purpose of improving pressure uniformity and temperature uniformity, it is preferred for the pressurizing member to have a large thickness as long as there comes no difficulty.

The electrophotographic photosensitive member is, like the unit example shown in FIGS. 1A and 1B, held by the supporting member 1-5 and rotated by drive or by follow-up movement. For the purpose of preventing the electrophotographic photosensitive member from being deformed, it is effective to provide through the interior of the cylindrical support a columnar holding guide made of a metal such as SUS stainless steel. Further, for the purpose of eliminating any pressure imbalance, a back-up roll may also be used in combination. A heating means and a cooling means which are of internal or external set-up may also be used in combination to make temperature control.

The mold is as described above. The units shown in FIGS. 4A and 4B and FIGS. 4C and 4D, have advantages that, from the viewpoint that the mold is placed on the pressurizing member, it can be placed at a high degree of freedom and also the mold itself can be heated with ease by means of a heating system of the pressurizing member.

From the viewpoint of continuous production, electrophotographic photosensitive members fastened to a plurality of supporting members may be rotated and moved relatively to the pressurizing member while being pressured. This can secure mass productivity.

Electrophotographic Photosensitive Member

Before the production process of the present invention is specifically described, materials, layer configuration and physical properties of the electrophotographic photosensitive member are described next.

The electrophotographic photosensitive member obtained by the production process of the present invention has a support and an organic photosensitive layer (hereinafter also simply "photosensitive layer") provided on the support. The electrophotographic photosensitive member according to the present invention may commonly be a cylindrical organic electrophotographic photosensitive member in which the photosensitive layer is formed on a cylindrical support, which is in wide use, and may also be applied to those having the shape of a belt or sheet.

The photosensitive layer may be either of a single-layer type photosensitive layer which contains a charge transporting material and a charge generating material in the same layer and a multi-layer type (function-separated type) photosensitive layer which is separated into a charge generation layer containing a charge generating material and a charge transport layer containing a charge transporting material. From the viewpoint of electrophotographic performance, the electrophotographic photosensitive member according to the present invention may preferably be the multi-layer type photosensitive layer. The multi-layer type photosensitive layer may also be a regular-layer type photosensitive layer in which the charge generation layer and the charge transport layer are superposed in this order from the support side and a reverse-layer type photosensitive layer in which the charge transport layer and the charge generation layer are superposed in this order from the support side. In the electrophotographic photosensitive member according to the present invention, where the multi-layer type photosensitive layer is employed, the charge generation layer may be constituted in multiple layer, and the charge transport layer may also be constituted in multiple layer. A protective layer may further be provided on the photosensitive layer for the purpose of, e.g., improving running performance.

As the support, it may at least be one having conductivity (conductive support). For example, usable are supports made of a metal (or made of an alloy) such as iron, copper, gold, silver, aluminum, zinc, titanium, lead, nickel, tin, antimony, indium, chromium, aluminum alloy or stainless steel. Also usable are the above supports made of a metal or supports made of a plastic, and having layers formed by vacuum deposition of aluminum, aluminum alloy, indium oxide-tin oxide alloy or the like. Still also usable are supports formed of plastic or paper impregnated with conductive fine particles such as carbon black, tin oxide particles, titanium oxide particles or silver particles together with a suitable binder resin, and supports made of a plastic containing a conductive binder resin.

For the purpose of prevention of interference fringes caused by scattering of laser light, the surface of the support may also be subjected to cutting, surface roughening or aluminum anodizing.

A conductive layer intended for the prevention of interference fringes caused by scattering of laser light or for the covering of scratches of the support surface may be provided between the support and an intermediate layer described later or the photosensitive layer (charge generation layer or charge transport layer).

The conductive layer may be formed using a conductive layer coating fluid prepared by dispersing and/or dissolving carbon black, a conductive pigment or a resistance control pigment in a binder resin. A compound capable of being cure-polymerized upon heating or irradiation may be added to the conductive layer coating fluid. As to the conductive layer in which a conductive pigment or a resistance control pigment has been dispersed, its surface tends to come roughened.

The conductive layer may preferably have a layer thickness of from 0.2 μm or more to 40 μm or less, more preferably from 1 μm or more to 35 μm or less, and still more preferably from 5 μm or more to 30 μm or less.

The binder resin used in the conductive layer may include, e.g., the following: Polymers or copolymers of vinyl compounds such as styrene, vinyl acetate, vinyl chloride, acrylate, methacrylate, vinylidene fluoride and trifluoroethylene, polyvinyl alcohol, polyvinyl acetal, polycarbonate, polyester, polysulfone, polyphenylene oxide, polyurethane, cellulose resins, phenol resins, melamine resins, silicon resins and epoxy resins.

The conductive pigment and the resistance control pigment may include, e.g., particles of metals (or alloys) such as aluminum, zinc, copper, chromium, nickel, silver and stainless steel, and plastic particles on the surface of which any of these metals has or have been vacuum-deposited. They may also be particles of metal oxides such as zinc oxide, titanium oxide, tin oxide, antimony oxide, indium oxide, bismuth oxide, indium oxide doped with tin, tin oxide doped with antimony or tantalum. Any of these may be used alone, or may be used in combination of two or more types. In the case when used in combination of two or more types, they may simply be mixed, or may be made into a solid solution or may be in the form of fusion.

An intermediate layer having the function as a barrier and the function of adhesion may also be provided between the support or the conductive layer and the photosensitive layer (the charge generation layer or the charge transport layer). The intermediate layer is formed for the purposes of, e.g., improving the adherence of the photosensitive layer, improving coating performance, improving the injection of electric charges from the support and protecting the photosensitive layer from any electrical breakdown.

Materials for the intermediate layer may include the following: Polyvinyl alcohol, poly-N-vinyl imidazole, polyethylene oxide, ethyl cellulose, an ethylene-acrylic acid copolymer, casein, polyamide, N-methoxymethylated nylon 6, copolymer nylons, glue and gelatin. The intermediate layer may be formed by coating an intermediate layer coating solution obtained by dissolving any of these materials in a solvent, and drying the wet coating formed.

The intermediate layer may preferably be in a layer thickness of 0.05 μm or more to 7 μm or less, and still more preferably from 0.1 μm or more to 2 μm or less.

The photosensitive layer in the present invention is described next.

The charge generating material used in the electrophotographic photosensitive member of the present invention may include the following: Pyrylium or thiapyrylium type dyes, phthalocyanine pigments having various central metals and various crystal types (such as α, β, γ, ϵ and X forms), anthanthrone pigments, dibenzpyrenequinone pigments, pyranthrone pigments, azo pigments such as monoazo, disazo and trisazo pigments, indigo pigments, quinacridone pigments, asymmetric quinocyanine pigments, quinocyanine pigments, and amorphous silicon. Any of these charge generating materials may be used alone, or may be used in combination of two or more.

The charge transporting material used in the electrophotographic photosensitive member of the present invention may include the following: Pyrene compounds, N-alkylcarbazole compounds, hydrazone compounds, N,N-dialkylaniline compounds, diphenylamine compounds and triphenylamine compounds. Also usable are triphenylmethane compounds, pyrazoline compounds, styryl compounds and stilbene compounds.

Where the photosensitive layer is functionally separated into a charge generation layer and a charge transport layer, the charge generation layer may be formed in the following way. That is, the charge generating material is dispersed together with a binder resin, which is used in a 0.3- to 4-fold quantity (mass ratio), and a solvent by means of a homogenizer, an ultrasonic dispersion machine, a ball mill, a vibration ball mill, a sand mill, an attritor or a roll mill. The charge generation layer coating fluid thus prepared by dispersion is coated.

The wet coating formed may be dried to form the charge generation layer. The charge generation layer may also be a vacuum-deposited film of the charge generating material.

The charge transport layer may be formed by coating a charge transport layer coating solution prepared by dissolving the charge transporting material and a binder resin in a solvent, and drying the wet coating formed. Also, of the above charge transporting materials, one having film forming properties alone may be film-formed alone without use of any binder resin to afford the charge transport layer.

The binder resin used in the charge generation layer and charge transport layer may include the following: Polymers or copolymers of vinyl compounds such as styrene, vinyl acetate, vinyl chloride, acrylate, methacrylate, vinylidene fluoride and trifluoroethylene, polyvinyl alcohol, polyvinyl acetal, polycarbonate, polyester, polysulfone, polyphenylene oxide, polyurethane, cellulose resins, phenol resins, melamine resins, silicon resins and epoxy resins.

The charge generation layer may preferably be in a layer thickness of from 0.01 μm or more to 5 μm or less, and still more preferably from 0.1 μm or more to 2 μm or less.

The charge transport layer may preferably be in a layer thickness of from 5 μm or more to 50 μm or less, and still more preferably from 10 μm or more to 35 μm or less.

To improve running performance which is one of properties required in electrophotographic photosensitive members, material designing of the charge transport layer serving as a surface layer is important in the case of the above function-separated type photosensitive layer. As examples thereof, it may be given to use a binder resin having a high strength, to control the proportion of a charge-transporting material showing plasticity to the binder resin, and to use a high-molecular charge-transporting material. In order to more bring out the running performance, it is effective for the surface layer to be made up of a cure type resin.

In the present invention, the charge transport layer itself may be made up of the cure type resin. On the above charge transport layer, a cure type resin layer may also be formed as a second charge transport layer or a protective layer. Properties required in the cure type resin layer are double features of film strength and charge-transporting ability, and such a layer is commonly made up of a polymerizable or cross-linkable monomer or oligomer. As occasion calls, resistance-controlled conductive fine particles may also be used in order to provide the charge-transporting ability.

As the charge-transporting material, any known hole-transporting compound or electron-transporting compound may be used. The polymerizable or cross-linkable monomer or oligomer may include chain polymerization type materials having an acryloyoxyl group or a styrene group, and successive polymerization type materials having a hydroxyl group, an alkoxysilyl group or an isocyanate group. From the viewpoints of resultant electrophotographic performance, general-purpose properties, material designing and production stability, it is preferable to use the hole-transporting compound and a chain polymerization type material in combination. Further, a system is particularly preferred in which a compound having both the hole-transporting compound and an acryloyoxyl group in the molecule is cured.

As a curing means, any known means may be used which makes use of heat, light or radiation.

Such a cured layer may preferably be, in the case of the charge transport layer, in a layer thickness of from 5 μm or more to 50 μm or less, and still more preferably from 10 μm or more to 35 μm or less, like the foregoing. In the case of the second charge transport layer or protective layer, it may preferably be in a layer thickness of from 0.1 μm or more to 20 μm or less, and still more preferably from 1 μm or more to 10 μm or less.

Various additives may be added to the respective layers of the electrophotographic photosensitive member of the present invention. Such additive may include deterioration preventives such as an antioxidant and an ultraviolet absorber, organic resin particles such as fluorine atom-containing resin particles and acrylic resin particles, and inorganic particles such as silica, titanium oxide and alumina particles.

To optimize the surface profile of the electrophotographic photosensitive member with the aim of improving cleaning performance, the present invention aims to provide a process for producing such an electrophotographic photosensitive member.

The electrophotographic photosensitive member production process according to the present invention has the step of bringing the mold having a stated surface profile into pressure contact with the surface of the electrophotographic photosensitive member to transfer the former's surface profile to the surface of the electrophotographic photosensitive member. Hence, mechanical physical properties of the charge transport layer or protective layer of the electrophotographic photosensitive member are especially important. Stated more specifically, what are very important are hardness, elastic deformation and parameters of plastic deformation against mechanical load on the charge transport layer or protective layer, a glass transition phenomenon or thermophysical properties in fusion, of constituent materials, and optimization of production conditions and surface processing steps.

In the present invention, the hardness, elastic deformation and parameters of plastic deformation against mechanical load on the electrophotographic photosensitive member surface layer may be expressed in numerical values by the universal hardness value (HU) and modulus of elastic deformation of the surface of the electrophotographic photosensitive member. These values may be measured with a microhardness measuring instrument FISCHER SCOPE H100V (manufactured by Fischer Co.) in an environment of 25° C./50% RH. This FISCHER SCOPE H100V is an instrument in which an indenter is brought into touch with a measuring object (the peripheral surface of the electrophotographic photosensitive member) and a load is continuously applied to this indenter, where the depth of indentation under application of the load is directly read to find the hardness continuously.

In the present invention, a Vickers pyramid diamond indenter having angles of 136 degrees between the opposite faces is used as the indenter. The indenter is pressed against the peripheral surface of the electrophotographic photosensitive member. The last of load (final load) applied continuously to the indenter is set to 6 mN, and the time (retention time) for which the state of application of the final load of 6 mN to the indenter is retained is set to 0.1 second. Also, measurement is made at 273 spots.

Figure 5:
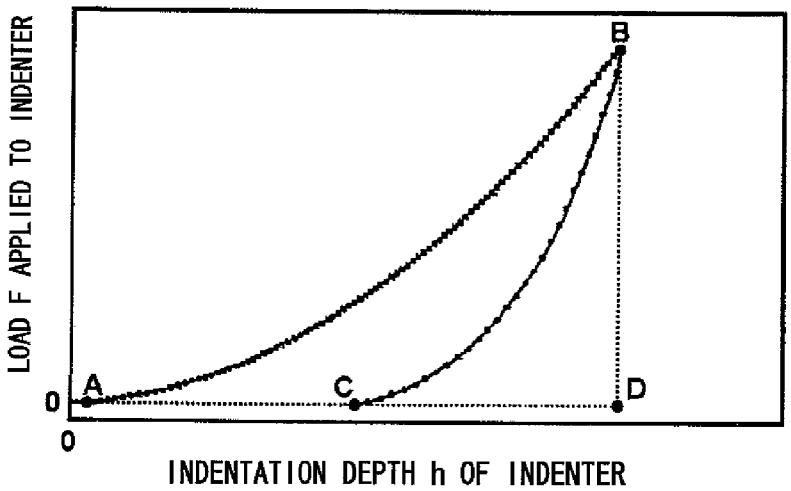
FIG. 5 is a graph showing an outline of an output chart of Fischer Scope H100V (manufactured by Fischer Co.).
Figure 6:
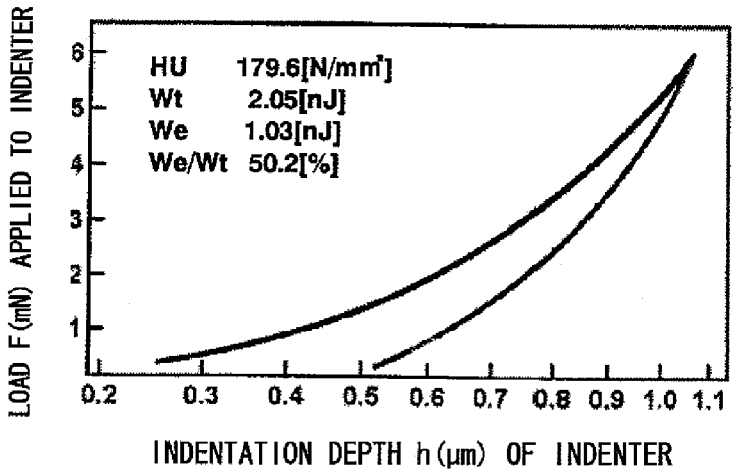
FIG. 6 is a graph showing an example of an output chart of Fischer Scope H100V (manufactured by Fischer Co.) where an electrophotographic photosensitive member obtained by the production process of the present invention is a measuring object.

An outline of an output chart of FISCHER SCOPE H100V (manufactured by Fischer Co.) is shown in FIG. 5. An example of an output chart of FISCHER SCOPE H100V (manufactured by Fischer Co.) at the time the electrophotographic photosensitive member of the present invention is the measuring object is also shown in FIG. 6. In FIGS. 5 and 6, the load F (mN) applied to the indenter is plotted as ordinate, and the depth of indentation h (μm) of the indenter as abscissa. FIG. 5 shows results obtained when the load F applied to the indenter is made to increase stepwise until the load comes maximum (from A to B), and thereafter the load is made to decrease stepwise (from B to C). FIG. 6 shows results obtained when the load F applied to the indenter is made to increase stepwise until the load comes finally to be 6 mN, and thereafter the load is made to decrease stepwise.

The universal hardness value (HU) may be found from the depth of indentation at the time the final load of 6 mN is applied, and from the following expression. In the following expression, $F_f$ stands for the final load, $S_f$ stands for the surface area of the part where the indenter is indented under application of the final load, and $h_f$ stands for the depth of indentation at the time the final load is applied.

$$HU=F_f[N]/S_f[\mathrm{mm}^2]=6\times10^{-3}/26.43\times(h_f\times10^{-3})^2.$$

The modulus of elastic deformation may be found from the work done (energy) by the indenter against the measuring object (the peripheral surface of the electrophotographic photosensitive member), i.e., the changes in energy that are due to increase and decrease of the load of the indenter against the measuring object (the peripheral surface of the electrophotographic photosensitive member). Stated specifically, the value found when the elastic deformation work done We is divided by the total work done Wt (We/Wt) is the modulus of elastic deformation. The total work done Wt is the area of a region surrounded by A-B-D-A in FIG. 5, and the elastic deformation work done We is the area of a region surrounded by C-B-D-C in FIG. 5.

The surface layer of the electrophotographic photosensitive member in the present invention refers to the charge transport layer or protective layer described above. In constituting a common charge transport layer formed using a thermoplastic resin and a charge-transporting material and in constituting the charge transport layer or protective layer formed as a cured layer, the surface may preferably have a universal hardness value (HU) in the range of from 150 to 350 $N/mm^2$ and a modulus of elastic deformation in the range of from 40 to 70%.

The value of thermophysical properties of the charge transport layer and protective layer may be measured as glass transition temperature of the thermoplastic resin and charge-transporting material of which the layers are constituted, as melting point of the charge-transporting material, or as glass transition temperature of the charge transport layer and protective layer. These glass transition temperature and melting point may be in the range of from 40° C. to 300° C. The glass transition temperature and the melting point may be measured with, e.g., a thermal analyzer SSC5200H, manufactured by Seiko Instruments Inc. Stated specifically, measurement is made at a heating rate of 10° C./minute in a temperature range of from 20° C. to 280° C. The point at which a tangent line of the solid side of the resultant chart and a tangent line at a steep position in the transition temperature region intersect is regarded as the melting point or the glass transition temperature.

How to Control Surface Profile

The surface profile processing steps are described below in greater detail with reference to FIGS. 7A, 7B and 7C.

Figure 7A:
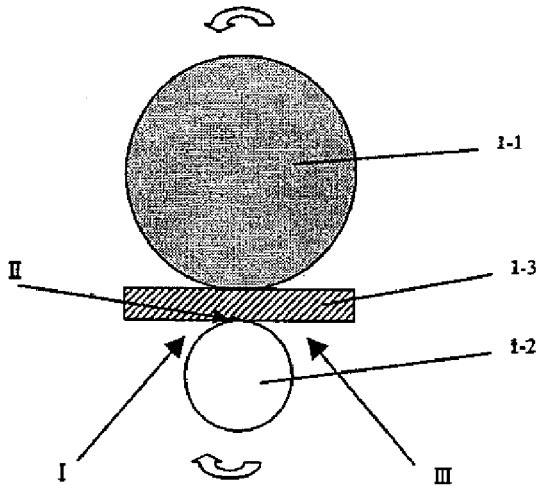
FIG. 7A is a conceptional view showing an example of a surface profile processing step where a surface processing unit having a roll type pressurizing member is used in the present invention.
Figure 7B:
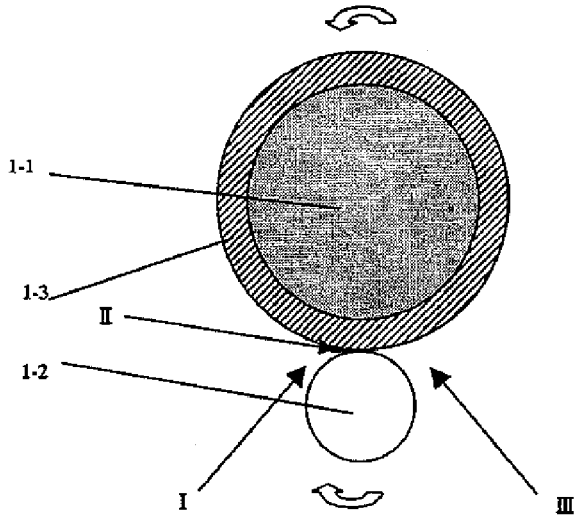
FIG. 7B is a conceptional view showing an example of a surface profile processing step where a surface processing unit having a roll type pressurizing member provided on its surface with a mold is used in the present invention.

FIGS. 7A and 7B each illustrate, in an example of a surface processing unit having the roll type pressurizing member shown in FIGS. 1A and 1B, the positional relationship between the pressurizing member and the electrophotographic photosensitive member as viewed from a section parallel to the rotational directions of the both.

FIG. 7A shows surface processing in which a mold 1-3 is provided between a pressurizing member 1-1 and an electrophotographic photosensitive member 1-2 and the surface profile of the mold is transferred to the surface of the electrophotographic photosensitive member while the pressurizing member 1-1 and the electrophotographic photosensitive member 1-2 are rotated in the directions of arrows. In FIG. 7A, reference numeral II denotes a zone where the step of pressure contact between the surface of the electrophotographic photosensitive member and the mold is carried out, forming a stated nip between them. Reference numerals I and III denote steps carried out before pressure contact and after pressure contact, respectively. In the present invention, the electrophotographic photosensitive member surface is continuously brought to the respective steps in these zones I, II and III, whereby a highly precise unevenness surface profile can be transferred to the surface.

FIG. 7B shows surface processing carried out in a unit in which a mold 1-3 is provided on the surface of a pressurizing member 1-1. Like that shown in FIG. 7A, the electrophotographic photosensitive member surface is continuously brought to the respective steps in the zones I, II and III, whereby the surface profile can be transferred to the surface.

Figure 7C:
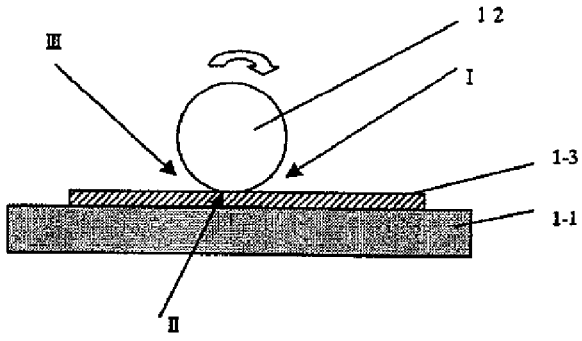
FIG. 7C is a conceptional view showing an example of a surface profile processing step where a surface processing unit having a flat-plate type pressurizing member is used in the present invention.

FIG. 7C illustrates, in an example of a surface processing unit having the flat-plate type pressurizing member shown in FIGS. 4A, 4B, 4C and 4D, the positional relationship between the pressurizing member and the electrophotographic photosensitive member as viewed from a section parallel to the rotational direction of the electrophotographic photosensitive member. This FIG. 7C shows surface processing in which a mold 1-3 is provided between a pressurizing member 1-1 and an electrophotographic photosensitive member 1-2 and the surface profile of the mold is transferred to the surface of the electrophotographic photosensitive member while the electrophotographic photosensitive member 1-2 is moved in the direction of an arrow. Like those shown in FIGS. 7A and 7B, the electrophotographic photosensitive member surface is continuously brought to the respective steps in zones I, II and III, whereby the surface profile can be transferred to the surface.

Figure 8:
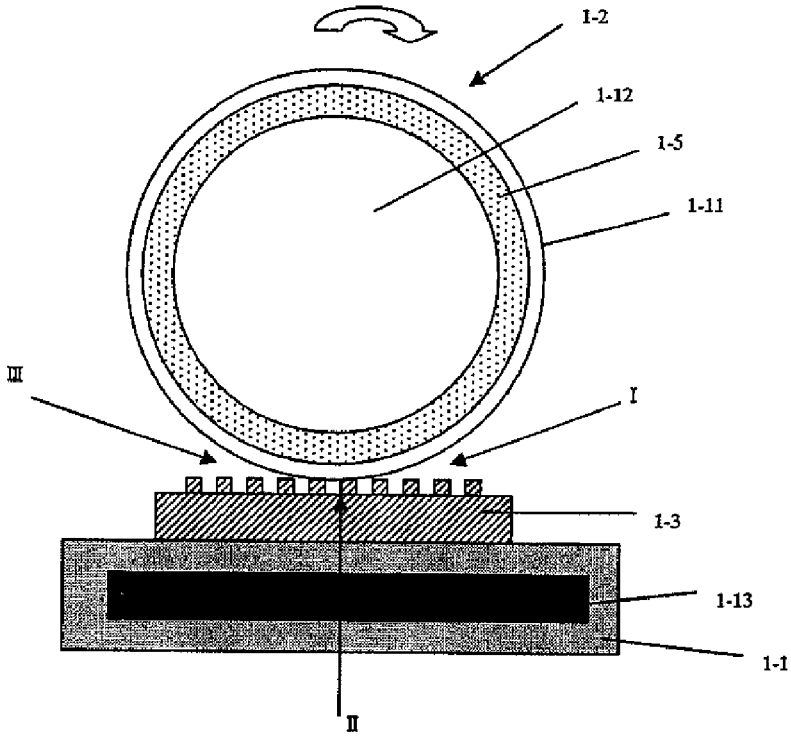
FIG. 8 is a conceptional view which illustrates in greater detail the surface profile processing step in FIG. 7C.

The surface processing is also described with reference to FIG. 8 which is a further enlarged view of the part of processing nip shown in FIG. 7C, and FIGS. 9A, 9B, 9C and 9D showing layer configuration of the electrophotographic photosensitive member. In FIG. 8, reference numeral 1-1 denotes a pressurizing member, 1-2, an electrophotographic photosensitive member; 1-3, a mold; 1-5, a support of the electrophotographic photosensitive member; 1-11, a surface layer (e.g., a charge transport layer or a protective layer) of the electrophotographic photosensitive member; 1-12, the interior of the support; and 1-13, a temperature control member provided in the interior of the pressurizing member.

The present invention is concerned with a process for producing an electrophotographic photosensitive member in which i) the surface of an electrophotographic photosensitive member having at least a charge transport layer on a cylindrical support and ii) a mold having a fine unevenness surface profile are brought into pressure contact with each other to transfer the fine unevenness surface profile to the surface of the electrophotographic photosensitive member. Then, this process is characterized in that the mold and the support are so temperature-controlled as to be T3<T1<T2 where the glass transition temperature of the charge transport layer is represented by T1 (° C.), the temperature of the mold by T2 (° C.), and the temperature of the support by T3 (° C.).

The electrophotographic photosensitive member having at least a charge transport layer on a cylindrical support may have a layer configuration specifically shown by examples of layer configuration which are shown in FIGS. 9A, 9B, 9C and 9D, inclusive of, as described previously, a case in which the charge transport layer is the surface layer and a case in which the protective layer is further formed on the charge transport layer, as described previously.

Figure 9A:
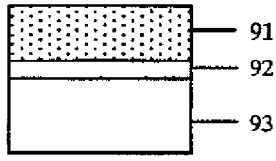
FIG. 9A is a view showing an example of the construction of an electrophotographic photosensitive member obtained by the production process of the present invention.
Figure 9B:
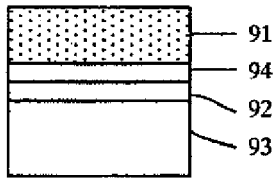
FIG. 9B is a view showing an example of the construction of an electrophotographic photosensitive member obtained by the production process of the present invention.
Figure 9C:
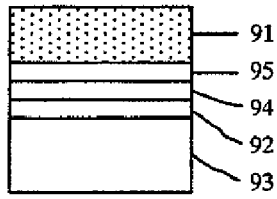
FIG. 9C is a view showing an example of the construction of an electrophotographic photosensitive member obtained by the production process of the present invention.

In the case when a charge transport layer 93 in the present invention is the surface layer as shown in FIGS. 9A, 9B, and 9C, the charge transport layer 93 may be constituted as shown below, for example.

Constituted of a charge-transporting material and a thermoplastic resin;

constituted of a curable resin in place of the thermoplastic resin;

constituted of a charge-transporting material having in itself a curable reactive group and capable of forming a cured film by itself; or constituted to form a cured film together with other thermoplastic resin.

To carry out the surface profile processing by heating and pressuring, the charge transport layer 93 may preferably have a glass transition temperature of from 50° C. or more to 200° C. or less. If it has a glass transition temperature of less than 50° C., it tends to be difficult to maintain the surface profile after surface processing because of a problem on its fluidity. If on the other hand it has a glass transition temperature of more than 200° C., such a charge transport layer is undesirable because it may adversely affect electrophotographic performance because of the heat at the time of surface processing.

Figure 9D:
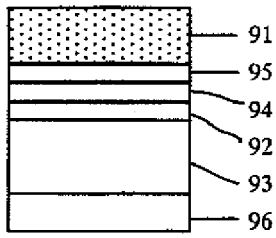
FIG. 9D is a view showing an example of the construction of an electrophotographic photosensitive member obtained by the production process of the present invention.

In the case when a protective layer 96 is the surface layer as shown in FIG. 9D, the charge transport layer lying beneath the protective layer may be of any constitution shown above. The protective layer 96, where it is made to function as a second charge transport layer constituted in the same way as the above charge transport layer 93, may be constituted of a charge-transporting material and a thermoplastic resin, may be constituted of a curable resin in place of the thermoplastic resin, may be constituted of a charge-transporting material having in itself a curable reactive group and capable of forming a cured film by itself, or may be constituted to form a cured film together with other thermoplastic resin. In this case, the charge transport layer 93 and the second charge transport layer which is the protective layer 96 may be constituted alike or differently. The protective layer 96 may also be constituted of only a thermoplastic resin or curable resin without use of any charge-transporting material. A conductive material may also be added thereto for the purpose of improving electrical properties. In FIGS. 9A, 9B, 9C and 9D, reference numeral 91 denotes a support; 92, a charge generation layer: 94, an intermediate layer; and 95, a subbing layer.

In the present invention, in the case when the protective layer is the surface layer, the protective layer may have glass transition temperature, or may not. Where the protective layer does not have any glass transition temperature or where it has a glass transition temperature of as high as more than 200° C., the surface profile of the electrophotographic photosensitive member may be processed chiefly by deformation due to pressuring and compression of the underlying layer charge transport layer. Here, a change in profile of the charge transport layer itself is observed. The upper layer, cure type surface layer changes in profile in the form that substantially follows up the underlying layer charge transport layer. In this case, mechanical properties of the cure type surface layer, chiefly its elastic deformation property, may have an influence on the profile transfer. More specifically, the profile of the charge transport layer having deformed as having thermoplasticity may tend to come relaxed because of internal stress, i.e., come out of shape. Hence, care must be taken of various conditions in the surface processing step.

In the present invention, to transfer a fine unevenness surface profile to the peripheral surface of the cylindrical electrophotographic photosensitive member, the surface processing is carried out while temperatures are so controlled as to satisfy the relationship of T3<T1<T2 where the glass transition temperature of the charge transport layer is represented by T1 (° C.), the temperature of the mold by T2 (° C.), and the temperature of the support by T3 (° C.). Under these conditions, the surface of the electrophotographic photosensitive member and the mold are brought into pressure contact with each other. This enables continuous efficient control of temperature rise and drop of the charge transport layer to prevent the problems that the surface profile comes out of shape, the processing surface comes wrinkled or wavy and the charge-transporting material precipitates. Thus, the fine unevenness surface profile can be transferred.

Stated specifically, this surface processing is continuously carried out in the zones shown by reference numerals I, II and III in this order in FIG. 7A, 7B and 7C or FIG. 8, in the course of pass at the nip between the electrophotographic photosensitive member and the mold. First, the reference numeral I denotes a zone in which the electrophotographic photosensitive member and the mold having a fine unevenness surface profile stands at an opposing position, where the electrophotographic photosensitive member surface portion to be just processed and the mold are in the state they have not come into contact with each other. In this zone, the electrophotographic photosensitive member and the mold substantially not stand in contact with each other. The reference numeral II denotes a zone in which the electrophotographic photosensitive member is rotated from the state of I to come into contact with the mold, forming a nip as the latter is moved. Further, the reference numeral III denotes a region in which the electrophotographic photosensitive member is further rotated from the state it is in contact with the mold, forming a nip, and the mold and the electrophotographic photosensitive member become parted from each other as the mold is moved. The temperature of the electrophotographic photosensitive member rises rapidly from the zone I to the zone II, and drops rapidly further from the zone II to the zone III. That is, the temperature of the charge transport layer comes maximum at the time the surface of the electrophotographic photosensitive member and the mold comes into contact with each other in the zone II, where the surface profile can simultaneously be transferred. In the present invention, it is intended that the surface processing carried out from the zone I to the zone III as above proceeds continuously on the peripheral surface of the electrophotographic photosensitive member. In the present invention, from the viewpoint of controllability of surface profile connecting marks on the peripheral surface of the electrophotographic photosensitive member, the step of surface processing in the zones of from I to III may be repeated in a plurality of times.

In the above step, the temperature of the charge transport layer is optimized by controlling the temperature of the mold, the temperature of the electrophotographic photosensitive member and the speed and time of surface processing. The temperature T2 of the mold must be set at a value exceeding the glass transition temperature T1 of the charge transport layer, in order to make it easy for the charge transport layer to undergo surface profile deformation.

Here, in order to perform good surface profile transfer, the temperature rise of the charge transport layer must be of sufficient extent in the zone II. Where the surface processing is carried out at a high speed, the temperature rise of the charge transport layer may come so insufficient as not to reach the glass transition temperature of the charge transport layer. Under such conditions, the pressure for carrying out the surface processing tends to increase, undesirably. Accordingly, the temperature T2 of the mold must be set at a sufficiently high temperature, or the temperature of the charge transport layer must previously be raised, or both of these must be used in combination. As a means therefor, the temperature of the support of the electrophotographic photosensitive member may be controlled within the range of T3<T1.

In general, the support used in the electrophotographic photosensitive member has so large heat conductivity and heat capacity as to be temperature-controlled with ease, compared with its upper layer photosensitive layer. Accordingly, its temperature is well controllable, and the temperature gradient between the temperature of the support and the temperature of the charge transport layer may effectively be utilized. Further, since the interior of the support is hollow, a member having a larger heat capacity than the support may preferably be inserted to the interior of the support for the purpose of more improving temperature controllability. In this case, the member having a larger heat capacity than the support may be made of a material which is the same as, or different from, that for the support. Stated specifically, where, e.g., the support is an unprocessed aluminum pipe, it may be a cylindrical support made of aluminum, a metal such as SUS stainless steel or copper, having a larger heat capacity, a ceramic or the like. Hot water may also be utilized after the support has been kept from water leak. Such a member having a large heat capacity may also be temperature-controlled. It, however, is important to control the temperature so that the temperature T3 of the support does not exceed T1 until the surface processing of the peripheral surface of the electrophotographic photosensitive member has all been completed.

Meanwhile, where the surface processing is carried out at a low speed, the temperature rise of the charge transport layer may sufficiently be made, but the charge transport layer tends to have too high temperature to make a sufficient temperature drop in the course of from the zone II to the zone III, tending to cause the problem of coming out of shape as stated previously. Also, it takes a long time until the surface processing of the peripheral surface of the electrophotographic photosensitive member has all been completed, and hence the temperature T3 of the support tends to exceed T1. Accordingly, it is very important to control the temperature of the support by heating and cooling. In this case as well, as stated above, the member having a larger heat capacity than the support may preferably be inserted to the interior of the support for the purpose of more improving temperature controllability. Such a member may preferably be further provided with a mechanism which controls the temperature of the support so that the temperature of the support can be controlled. It is also effective to provide it with a cooling mechanism for the purpose of controlling any excess temperature rise.

As described above, it is preferable that the temperature of the charge transport layer in the zone I is maintained at a temperature not higher than the glass transition temperature of the charge transport layer and that the electrophotographic photosensitive member surface is pressured by the pressurizing member, interposing the mold between them, at the time it passes through the nip in the zone II simultaneously at the time of heating, and thereafter, simultaneously with the removal of pressure, the electrophotographic photosensitive member is so cooled that in the zone III the temperature of the charge transport layer may again be maintained at a temperature not higher than its glass transition temperature. More specifically, it is preferable that the temperature of the support, the temperature of the mold and the surface processing speed are so controlled as to be T1<T4 where the maximum value of the temperature of the charge transport layer at the part of pressure contact between the surface of the electrophotographic photosensitive member and the mold is represented by T4 (° C.). It is unnecessary to carry out the pressuring at a vastly high pressure in order to secure a sufficient surface profile transfer reproducibility, and it can be avoided that the surface processing comes in a low precision due to any deformation of the electrophotographic photosensitive member and a large-sized production apparatus comes required.

It is also preferable that the charge transport layer is formed through i) the step of coating a charge transport layer coating solution containing at least a binder resin and a charge-transporting material and ii) the step of drying, and the temperature of the support, the temperature of the mold and the surface processing speed are so controlled as to be T5<T4 where the maximum value of the temperature of the charge transport layer in the drying step is represented by T5 (° C.). The larger the difference between T5 and T4 is, the more the surface profile transfer reproducibility shows a tendency to be improved.

In the present invention, it is further preferable that temperatures are so controlled as to be T6<T1 where the maximum value of the temperature of the charge transport layer at the part other than the part of pressure contact between the surface of the electrophotographic photosensitive member and the mold is represented by T6 (° C.). According to this method, the surface profile can be transferred to the peripheral surface of the cylindrical electrophotographic photosensitive member at its surface-unprocessed area while the temperature of the charge transport layer in its area having already been surface-processed is maintained at a temperature not higher than the glass transition temperature. Hence, the problem that the surface profile having first been formed by surface processing may come out of shape as so questioned in the background art can vastly been eliminated. In particular, compared with common surface processing of products of thermoplastic resins, the surface processing of the electrophotographic photosensitive member having the charge transport layer containing a binder resin and a charge-transporting material tends to make the surface profile come out of shape. Hence, the above conditions are particularly preferred.

Meanwhile, it is preferable that temperatures are so controlled as to be T4<T7 where the melting point of the charge-transporting material of the charge transport layer is represented by T7 (° C.). More specifically, the temperature of the support, the temperature of the mold and the surface processing speed may preferably be so controlled that the maximum value T4 (° C.) of the temperature of the charge transport layer at the part of pressure contact between the surface of the electrophotographic photosensitive member and the mold may be lower than the melting point T7 (° C.) of the charge-transporting material. This is because the problems that the surface profile having been transferred comes out of shape, the processing surface comes wrinkled or wavy and the charge-transporting material precipitates can effectively be kept from arising.

As described above, the controlling of the temperature of the support, the temperature of the mold and the surface processing speed enables transfer of a good surface profile. Further, the controlling of the temperature T3 (° C.) to be a temperature not higher than room temperature enables transfer of a better surface profile. That is, stated specifically, the member having a larger heat capacity than the cylindrical support is inserted to the interior of the cylindrical support, and the member having a larger heat capacity is provided with a mechanism which controls the temperature of the support to be a temperature not higher than room temperature. Thus, the temperature of the mold and the processing time can be so controlled that the temperature T3 (° C.) of the support during the surface processing may be maintained at the temperature not higher than room temperature. Here, a cooling mechanism may be used in combination with the member having a larger heat capacity, to keep the support temperature from rising.

The pressuring force of the mold against the electrophotographic photosensitive member surface layer in the present invention is described next. In the present invention, the pressure applied to the electrophotographic photosensitive member surface in the zone II may be from 0.1 MPa or more to 50 MPa or less, whereby a stated surface profile cab be transferred in a high precision. Specific pressure within the above range may appropriately be selected in accordance with the materials and layer configuration used in the electrophotographic photosensitive member and the pattern profile of the mold. The pressure may be measured using a commercially available pressure-sensitive sheet.

Surface processing time in the present invention is described next. In the present invention, it is preferable that the cylindrical electrophotographic photosensitive member is rotated in its peripheral direction, and the fine unevenness surface profile is thereby continuously transferred to the surface of the electrophotographic photosensitive member in its peripheral direction, thus the peripheral surface of the electrophotographic photosensitive member is continuously surface-processed. The speed of rotation at this processing is optimized together with the above temperature control and pressuring force. Stated approximately, it may be controlled within the range of from 1 mm/second to 200 mm/second as surface movement speed of the electrophotographic photosensitive member. Here, nip pass time in the zone II may approximately be within the range of from few milliseconds to few seconds, which depend on the construction of the apparatus, the layer configuration of the electrophotographic photosensitive member and the nip width that may change depending on the above temperature and pressure. During that time, a series of steps of the above heating, pressuring and cooling are carried out.

How to Observe Surface Profile

In the present invention, the surface of the electrophotographic photosensitive member having been surface-processed may be observed on a commercially available laser microscope, optical microscope, electron microscope or atomic force microscope.

As the laser microscope, the following equipment may be used, for example. An ultradepth profile measuring microscope VK-8550, an ultradepth profile measuring microscope VK-9000 and an ultradepth profile measuring microscope VK-9500 (all manufactured by Keyence Corporation), a profile measuring system SURFACE EXPLORER SX-520DR model instrument (manufactured by Ryoka Systems Inc.), a scanning confocal laser microscope OLS3000 (manufactured by Olympus Corporation), and a real-color confocal microscope OPTELICS C130 (manufactured by Lasertec Corporation).

As the optical microscope, the following equipment may be used, for example. A digital microscope VHX-500 and a digital microscope VHX-2000 (both manufactured by Keyence Corporation) and a 3D digital microscope VC-7700 (manufactured by Omron Corporation).

As the electron microscope, the following equipment may be used, for example. A 3D real surface view microscope VE-9800 and a 3D real surface view microscope VE-8800 (both manufactured by Keyence Corporation), a scanning electron microscope Conventional/Variable Pressure System SEM (manufactured by SII Nano Technology Inc.), and a scanning electron microscope SUPER SCAN SS-550 (manufactured by Shimadzu Corporation).

As the atomic force microscope, the following equipment may be used, for example. A nanoscale hybrid microscope VN-8000 (manufactured by Keyence Corporation), a scanning probe microscope NanoNavi Station (manufactured by SII Nano Technology Inc.), and a scanning probe microscope SPM-9600 (manufactured by Shimadzu Corporation).

Using the above microscope, a surface profile in the measurement visual field may be observed at stated magnifications to measure the size and depth of the surface profile and unevenness. Automatic calculation may also be made by using analytical software.

Measurement with Surface Explorer SX-520DR model instrument, making use of an analytical program, is described as an example. A measuring object electrophotographic photosensitive member is placed on a work stand. The tilt is adjusted to bring the stand to a level, where three-dimensional profile data of the peripheral surface of the electrophotographic photosensitive member are entered in the analyzer in a wave mode. Here, the objective lens may be set at 50 magnifications under observation in a visual field of 100 μm×100 μm (10,000 $\mu m^2$)

Next, contour line data of the surface of the electrophotographic photosensitive member are displayed by using a particle analytical program set in the data analytical software.

Hole analytical parameters of depressed portions, such as the profile or shape of depressed portions, the size of hills and dales and the depth of depressed portions may each be optimized according to the depressed portions formed. For example, where depressed portions of about 10 μm in major-axis diameter are observed and measured, average values of the size and depth of hills and dales may be measured setting the upper limit of major-axis diameter at 15 μm, the lower limit of major-axis diameter at 1 μm, the lower limit of depth at 0.1 μm and the lower limit of volume at 1 $\mu m^3$ or more.

Electrophotographic Apparatus

Figure 10:
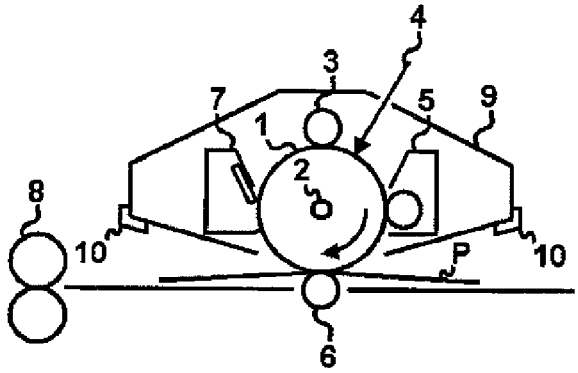
FIG. 10 is a schematic view showing an example of the construction of an electrophotographic apparatus provided with a process cartridge having an electrophotographic photosensitive member obtained by the production process of the present invention.

An example of the construction of an electrophotographic apparatus provided with a process cartridge having the electrophotographic photosensitive member produced according to the present invention is shown in FIG. 10.

In FIG. 10, reference numeral 1 denotes a cylindrical electrophotographic photosensitive member, which is rotatingly driven around an axis 2 in the direction of an arrow at a stated peripheral speed.

The surface of the electrophotographic photosensitive member 1 rotatingly driven is uniformly electrostatically charged to a positive or negative, given potential through a charging means (primary charging means such as a charging roller) 3. The electrophotographic photosensitive member thus charged is then exposed to exposure light (imagewise exposure light) 4 emitted from an exposure means (not shown) for slit exposure or laser beam scanning exposure. In this way, electrostatic latent images corresponding to the intended image are successively formed on the peripheral surface of the electrophotographic photosensitive member 1. The charging means 3 is not limited to a contact charging means making use of the charging roller as shown in FIG. 10, and may be a corona charging means making use of a corona charging assembly, or may be a charging means of any other system.

The electrostatic latent images thus formed on the peripheral surface of the electrophotographic photosensitive member 1 are developed with a toner a developing means 5 has, to form toner images. Then, the toner images thus formed and held on the peripheral surface of the electrophotographic photosensitive member 1 are successively transferred by applying a transfer bias from a transfer means (such as a transfer roller) 6, which are successively transferred on to a transfer material (such as plain paper or coated paper) P fed from a transfer material feed means (not shown) to the part (contact zone) between the electrophotographic photosensitive member 1 and the transfer means 6 in the manner synchronized with the rotation of the electrophotographic photosensitive member 1. A system may also be used in which the toner images are first transferred to an intermediate transfer drum or intermediate transfer belt in place of the transfer material and thereafter further transferred to the transfer material.

The transfer material P to which the toner images have been transferred is separated from the peripheral surface of the electrophotographic photosensitive member 1 is led through a fixing means 8, where the toner images are fixed, and is then put out of the apparatus as an image-formed material (a print or a copy).

The peripheral surface of the electrophotographic photosensitive member 1 from which the toner images have been transferred is brought to removal of the toner remaining after the transfer, through a cleaning means (such as a cleaning blade) 7. Thus, its surface is cleaned. It is further subjected to charge elimination by pre-exposure light (not shown) emitted from a pre-exposure means (not shown), and thereafter repeatedly used for the formation of images.

Incidentally, where as shown in FIG. 10 the charging means 3 is the contact charging means making use of a charging roller, the pre-exposure is not necessarily required.

The apparatus may be constituted of a combination of plural components integrally joined in a container as a process cartridge from among the constituents such as the above electrophotographic photosensitive member 1, charging means 3, developing means 5, transfer means 6 and cleaning means 7 so that the process cartridge is set detachably mountable to the main body of an electrophotographic apparatus such as a copying machine or a laser beam printer. In the apparatus shown in FIG. 10, the electrophotographic photosensitive member 1 and the charging means 3, developing means 5 and cleaning means 7 are integrally supported to form a cartridge to set up a process cartridge 9 that is detachably mountable to the main body of the electrophotographic apparatus through a guide means 10 such as rails provided in the main body of the electrophotographic apparatus.

EXAMPLES

The present invention is described below in greater detail by giving specific working examples. In the following Examples, "part(s)" is meant to be "part(s) by weight".

Example 1

An aluminum cylinder of 30 mm in diameter, 357.5 mm in length and 1 mm in wall thickness was used as a support (cylindrical support).

Next, 60 parts of a powder (trade name: PASTRAN PC1; available from Mitsui Mining & Smelting Co., Ltd.) composed of barium sulfate particles having coat layers of tin oxide), 15 parts of titanium oxide (trade name: TITANIX JR; available from Tayca Corporation), 43 parts of a resol type phenolic resin (trade name: PHENOLITE J-325; available from Dainippon Ink & Chemicals, Incorporated; solid content: 70%), 0.015 part of silicone oil (trade name: SH28PA; available from Toshiba Silicone Co., Ltd.), 3.6 parts of silicone resin (trade name: TOSPEARL 120; available from Toshiba Silicone Co., Ltd.) and a solution composed of 50 parts of 2-methoxy-l-propanol and 50 parts of methanol were subjected to dispersion for about 20 hours by means of a ball mill to prepare a conductive layer coating fluid. The conductive layer coating fluid thus prepared was applied on the aluminum cylinder by dip coating, followed by heat curing for 1 hour in an oven kept at a temperature of 140° C., to form a resin layer with a layer thickness of 15 μm.

Next, a solution prepared by dissolving 10 parts of a copolymer nylon resin (trade name: AMILAN CM8000; available from Toray Industries, Inc.) and 30 parts of a methoxymethylated nylon 6 resin (trade name: TORESIN EF-30T; available from Teikoku Chemical Industry Co., Ltd.) in a mixed solvent of 400 parts of methanol and 200 parts of n-butanol was applied on the above resin layer by dip coating, followed by heat drying for 30 minutes in an oven kept at a temperature of 100° C., to form an intermediate layer with a layer thickness of 0.45 μm.

Next, 20 parts of hydroxygallium phthalocyanine having strong peaks at Bragg angles of 2θ plus-minus 0.2° of 7.4° and 28.2° in CuKα characteristics X-ray diffraction, 0.2 part of carixarene represented by the following structural formula (1):

(1)

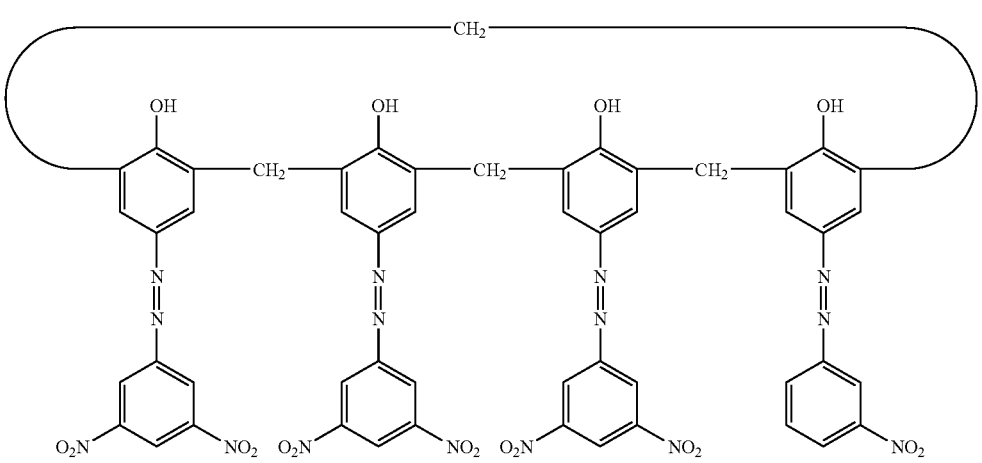

10 parts of polyvinyl butyral (trade name: S-LEC BX-1, available from Sekisui Chemical Co., Ltd.) and 600 parts of cyclohexanone were subjected to dispersion for 4 hours by means of a sand mill making use of glass beads of 1 mm in diameter, and then 700 parts of ethyl acetate was added to prepare a charge generation layer coating dispersion. This was applied on the intermediate layer by dip coating, followed by heat drying for 15 minutes in an oven kept at a temperature of 80° C., to form a charge generation layer with a layer thickness of 0.170 μm.

Next, 70 parts of a hole transporting compound represented by the following structural formula (2):

(2)

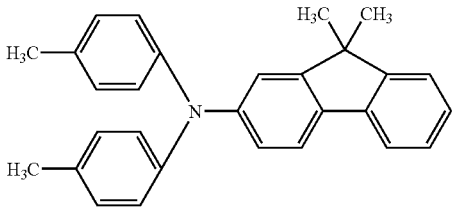

and 100 parts of a polycarbonate resin (trade name: IUPILON Z400; available from Mitsubishi Engineering-Plastics Corporation) were dissolved in a mixed solvent of 600 parts of monochlorobenzene and 200 parts of methylal to prepare a charge transport layer coating solution. This charge transport layer coating solution was applied on the charge generation layer by dip coating, followed by heat drying for 30 minutes in an oven kept at a temperature of 100° C., to form a charge transport layer with a layer thickness of 15 μm.

Next, 0.5 part of a fluorine atom-containing resin (trade name: GF-300, available from Toagosei Chemical Industry Co., Ltd.) as a dispersant was dissolved in a mixed solvent of 30 parts of 1,1,2,2,3,3,4-heptafluorocyclopentane (trade name: ZEOROLA H, available from Nippon Zeon Co., Ltd.) and 30 parts of 1-propanol, and thereafter 10 parts of a tetrafluoroethylene resin powder (trade name: LUBRON L-2, available from Daikin Industries, Ltd.) was added as a lubricant, followed by uniform dispersion by carrying out treatment four times under a pressure of 600 kgf/cm$^2$ by means of a high-pressure dispersion machine (trade name: MICROFLUIDIZER M-110EH, manufactured by Microfluidics Inc., USA). The dispersion obtained was filtered with Polyfron filter (trade name: PF-040, available from Advantec Co., Ltd.) to prepare a lubricant dispersion. Thereafter, 90 parts of a hole transporting compound represented by the following formula (3), 60 parts of 1,1,2,2,3,3,4-heptafluorocyclopentane and 60 parts of 1-propanol were added to the lubricant dispersion, followed by filtration with Polyfron filter (trade name: PF-020, available from Advantec Co., Ltd.) to prepare a protective layer coating fluid.

(3)

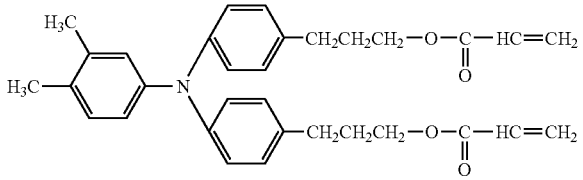

Using this coating fluid, a protective layer was formed on the charge transport layer by coating, followed by drying for 10 minutes in the atmosphere in an oven kept at a temperature of 50° C. Thereafter, the layer formed was irradiated with electron rays for 1.6 seconds in an atmosphere of nitrogen and under conditions of an accelerating voltage of 150 kV and a beam current of 3.0 mA while rotating the cylinder at 200 rpm. Subsequently, in an atmosphere of nitrogen, the temperature was raised from 25° C. to 125° C. over a period of 30 seconds to carry out curing reaction. Here, the absorbed dose of electron rays was measured to find that it was 15 KGy. Oxygen concentration in the atmosphere of electron ray irradiation and heat curing reaction was found to be 15 ppm or less. Thereafter, the resultant electrophotographic photosensitive member was naturally cooled in the atmosphere to a temperature of 25° C., and then subjected to post-heat-treatment for 30 minutes in the atmosphere in an oven kept at a temperature of 100° C., to form a cure type protective layer with a layer thickness of 5 μm. Thus, an electrophotographic photosensitive member was obtained.

The electrophotographic photosensitive member thus obtained was placed in the surface profile processing unit shown in FIGS. 4C and 4D, in an environment of room temperature 25° C. Its pressurizing member was made of SUS stainless steel, and was provided in its interior with a heater for heating it. As the mold, a mold made of nickel and having a thickness of 50 μm was used which had a columnar surface profile like that shown in FIGS. 3A, 3B and 3C, and this was fastened onto the pressurizing member. Here, its columns were each in a diameter Y of 5 μm and a height Z of 2 μm and a pitch of 7.5 μm. A columnar holding member made of SUS stainless steel and having substantially the same inner diameter of the support was inserted to the interior of the cylindrical support of the electrophotographic photosensitive member. Here, the pressurizing member was not temperature-controlled. Using the unit constructed as above, the electrophotographic photosensitive member was surface-processed under conditions shown in Table 1. In Table 1, the temperature T1 of the charge transport layer and the melting point T7 of the charge-transporting material which were separately measured are shown together. In regard to the temperature T3 of the support, temperatures at the start and finish of the surface processing are shown in respect of the one not temperature-controlled.

Various temperatures were measured in the following way. The temperature T2 of the mold was measured by bringing a tape contact type thermocouple (ST-14K-008-TS 1.5-ANP, manufactured by Anritsu Meter Co., Ltd.) into contact with the surface of the mold. The temperature T3 of the support was measured by previously placing the tape contact type thermocouple on the inner surface of the support.

To measure the temperature of the charge transport layer of the electrophotographic photosensitive member in the course of the surface processing, an electrophotographic photosensitive member for temperature measurement was separately produced. The electrophotographic photosensitive member for temperature measurement was produced in the following way.

First, like the electrophotographic photosensitive member for surface profile processing, a charge transport layer of 15 μm in layer thickness was formed, and thereafter fine gauge thermocouples of 25 μm each in tip diameter (KFT-25-100, manufactured by Anbe SMT Co.) were fastened with a silver paste at four spots of the charge transport layer surface (divided into four equal spots in the lengthwise direction of the cylindrical electrophotographic photosensitive member). These thermocouples were covered with a single layer (1 cm square) of a cure type protective layer having a layer thickness of 5 μm and having separately been formed, and thereafter fastened. This was used as the electrophotographic photosensitive member for temperature measurement.

The single layer of the cure type protective layer was prepared by cutting a 1 cm square protective layer out of a cure type protective layer of 5 μm in layer thickness, having directly been formed on an aluminum cylinder of 30 mm in diameter, 357.5 mm in length and 1 mm in wall thickness.

Using the electrophotographic photosensitive member for temperature measurement, obtained as described above, the temperature was measured by monitoring changes in temperature during the surface processing while carrying out the surface processing actually. As to the temperature T4 of the charge transport layer at the part of pressure contact between the surface of the electrophotographic photosensitive member and the mold, the temperature at the time of nip passing (zone II) was regarded as its maximum value. As to the temperature T6 of the charge transport layer at the part other than the part of pressure contact between the surface of the electrophotographic photosensitive member and the mold, the temperature at the part other than the part of pressure contact was regarded as its maximum value.

The surface of the electrophotographic photosensitive member obtained was observed with a laser microscope VK-8500 (manufactured by Keyence Corporation) to measure the profile and diameter (major-axis diameter) of depressed portions and the depth (depth of depressed portions). The diameter (major-axis diameter) and the depth were measured as average values in the observation per 100 μm square. Profile transfer performance was evaluated in the following way.

A: The unevenness profile is in a reproducibility of 98% or more in diameter and a reproducibility of 60% or more in depth with respect to the mold.

B: The unevenness profile is in a reproducibility of 95% or more in diameter and a reproducibility of 45% or more in depth with respect to the mold.

C: The unevenness profile is in a reproducibility of 90% or more in diameter and a reproducibility of 25% or more in depth with respect to the mold.

D: The unevenness profile is in a reproducibility of 60% or more in diameter and a reproducibility of 10% or more in depth with respect to the mold.

E: The unevenness profile is in a reproducibility of less than 60% in diameter and a reproducibility of less than 10% in depth with respect to the mold.

The results are shown in Table 1. The production process in the present Example brought a good profile transfer performance.

TABLE 1

| | Charge transport layer thermo-physical properties | | Support temperature, charge transport layer temp. during surface processing & charge transport layer drying temp. | | | | Surface profile processing conditions | | | Observation results and evaluation | | |
|---|---|---|---|---|---|---|---|---|---|---|---|---|
| | T1: Transition temp. (° C.) | T7: Melting point of charge transporting material (° C.) | T3: Support temp. (° C.) | T6: Max. temp. of charge transport layer at part other than nip zone (° C.) | T5: Max. temp. of charge transport layer during drying (° C.) | T4: Max. temp. of charge transport layer at nip zone (° C.) | T2: Profile providing material temp. (° C.) | Surface processing pressure (MPa) | Surface processing speed (mm/s) | Average value of major axis diam. (μm) | Average value of depth (μm) | Overall evaluation and remarks |
| | | | | | | Example: | | | | | | |
| 1 | 75 | 141 | 25→30 | 35 | 100 | 110 | 135 | 8 | 15 | 4.9 | 1.0 | B |
| 2 | 75 | 141 | 25→30 | 35 | 100 | 110 | 135 | 30 | 15 | 4.9 | 1.0 | B |
| 3 | 75 | 141 | 25→30 | 35 | 100 | 105 | 160 | 8 | 100 | 4.8 | 0.9 | B |
| 4 | 75 | 141 | 25→30 | 35 | 100 | 105 | 200 | 8 | 200 | 4.8 | 0.9 | B |
| 5 | 75 | 141 | 25→45 | 50 | 100 | 110 | 135 | 8 | 15 | 4.8 | 0.9 | B |
| 6 | 75 | 141 | 25→30 | 35 | 100 | 70 | 100 | 30 | 15 | 3.0 | 0.5 | D |
| 7 | 75 | 141 | 45 | 45 | 100 | 150 | 200 | 8 | 10 | 4.9 | 1.0 | D(*1) |
| 8 | 75 | 141 | 25→70 | 80 | 100 | 125 | 150 | 2 | 5 | 3.5 | 0.5 | D |
| 9 | 75 | 141 | 25 | 25 | 100 | 110 | 135 | 8 | 15 | 5.0 | 1.2 | A |
| 10 | 75 | 141 | 20 | 20 | 100 | 110 | 160 | 8 | 5 | 5.0 | 1.4 | A |
| 11 | 75 | 141 | 35 | 35 | 100 | 125 | 150 | 6 | 15 | 5.0 | 1.2 | A |
| 12 | 75 | 141 | 35 | 35 | 100 | 140 | 180 | 4 | 15 | 5.0 | 1.4 | A |
| 13 | 80 | 141 | 25→30 | 35 | 120 | 110 | 135 | 8 | 15 | 4.5 | 0.5 | C |
| 14 | 90 | 141 | 25→30 | 35 | 140 | 130 | 160 | 8 | 15 | 4.5 | 0.5 | C |
| 15 | 100 | 169 | 45→65 | 70 | 120 | 150 | 175 | 8 | 5 | 4.9 | 1.0 | B |
| 16 | 100 | 169 | 45 | 45 | 120 | 150 | 175 | 8 | 5 | 5.0 | 1.2 | A |
| 17 | 100 | 169 | 45 | 45 | 120 | 175 | 200 | 8 | 5 | 5.0 | 1.2 | D(*1) |
| 18 | 100 | 169 | 45 | 45 | 120 | 150 | 175 | 8 | 5 | 1.0 | 0.6 | A |
| 19 | 100 | 169 | 45 | 45 | 120 | 150 | 175 | 8 | 5 | 10 | 1.6 | A |
| 20 | 100 | 169 | 45 | 45 | 120 | 150 | 175 | 8 | 5 | 2.0 | 3.5 | A |
| 21 | 100 | 169 | 45 | 45 | 155 | 150 | 175 | 8 | 5 | 4.5 | 0.5 | C |
| 22 | 75 | 141 | 35 | 35 | 100 | 110 | 135 | 8 | 15 | 5.0 | 1.5 | A |
| 23 | 85 | 141 | 35 | 35 | 100 | 130 | 145 | 8 | 10 | 5.0 | 1.5 | A |
| 24 | 85 | 141 | 35 | 35 | 100 | 95 | 110 | 8 | 15 | 4.5 | 0.5 | C |
| 25 | 85 | 141 | 35 | 35 | 100 | 140 | 180 | 8 | 15 | 5.0 | 1.8 | A |
| 26 | 85 | 141 | 25→45 | 50 | 100 | 130 | 145 | 8 | 10 | 4.9 | 1.0 | B |

TABLE 1-continued

| | Charge transport layer thermo-physical properties | | Support temperature, charge transport layer temp. during surface processing & charge transport layer drying temp. | | | | Surface profile processing conditions | | | Observation results and evaluation | | |
|---|---|---|---|---|---|---|---|---|---|---|---|---|
| | T1: Transition temp. (° C.) | T7: Melting point of charge transporting material (° C.) | T3: Support temp. (° C.) | T6: Max. temp. of charge transport layer at part other than nip zone (° C.) | T5: Max. temp. of charge transport layer during drying (° C.) | T4: Max. temp. of charge transport layer at nip zone (° C.) | T2: Profile providing material temp. (° C.) | Surface processing pressure (MPa) | Surface processing speed (mm/s) | Average value of major axis diam. (μm) | Average value of depth (μm) | Overall evaluation and remarks |
| | | | | | | Comparative Example: | | | | | | |
| 1 | 75 | 141 | 85 | 85 | 100 | 110 | 135 | 8 | 15 | 2.5 | 0.1 | E |
| 2 | 75 | 141 | 100 | 100 | 100 | 110 | 135 | 8 | 15 | 0.5 | 0.1 | E |
| 3 | 75 | 141 | 25 | 25 | 100 | 40 | 70 | 30 | 15 | 0 | 0 | E |
| 4 | 75 | 141 | 25→80 | 90 | 100 | 120 | 160 | 2 | 5 | 2.0 | 0.1 | E |
| 5 | 75 | 141 | 85 | 85 | 100 | 110 | 135 | 8 | 15 | 2.5 | 0.1 | E |

(*1)partially out of shape

Examples 2 to 4

In Example 1, electrophotographic photosensitive members were produced in the same manner as that in Example 1 except that the surface profile processing was carried out under conditions shown in Table 1. Evaluation was made in the same way.

Example 5

In Example 1, an electrophotographic photosensitive member was produced in the same manner as that in Example 1 except that the holding member in the interior of the support, which member was made of SUS stainless steel, was changed for a holding member made of aluminum. Evaluation was made in the same way. As the result, a temperature rise of the support was observed, and a slightly low profile reproducibility tended to result.

Example 6

In Example 1, an electrophotographic photosensitive member was produced in the same manner as that in Example 1 except that the temperature 135° C. of the mold was changed to 100° C. and the surface processing pressure 8 MPa was changed to 30 MPa. Evaluation was made in the same way. As the result, a low profile reproducibility tended to result because the temperature of the charge transport layer at the part of pressure contact between the surface of the electrophotographic photosensitive member and the mold during the surface processing was lower than the glass transition temperature of the charge transport layer.

Example 7

In Example 1, an electrophotographic photosensitive member was produced in the same manner as that in Example 1 except that the holding member inserted to the interior of the support was so temperature-controlled as to be maintained at 45° C. during the surface processing and that the surface profile processing was carried out under conditions shown in Table 1. Evaluation was made in the same way. As the result, the surface profile was mostly in a good reproducibility, but a low profile reproducibility was very partly seen. This is considered due to the fact that the temperature of the charge transport layer at the part of pressure contact between the surface of the electrophotographic photosensitive member and the mold during the surface processing was more than the melting point of the charge-transporting material.

Example 8

In Example 1, an electrophotographic photosensitive member was produced in the same manner as that in Example 1 except that the aluminum cylinder of 1 mm in wall thickness was changed for that of 3 mm, that the holding member was not inserted to the interior of the support and that the surface profile processing was carried out under conditions changed as shown in Table 1. Evaluation was made in the same way. As the result, a temperature rise of the support was seen, and an inferior profile reproducibility tended to result.

Example 9

In Example 7, an electrophotographic photosensitive member was produced in the same manner as that in Example 1 except that the temperature 45° C. at which the support was maintained was changed to 25° C. and that the surface profile processing was carried out under conditions changed as shown in Table 1. Evaluation was made in the same way. As the result, a good profile reproducibility was achieved.

Examples 10 to 12

In Example 9, electrophotographic photosensitive members were produced in the same manner as that in Example 9 except that the temperature at which the support was maintained and the surface processing conditions were changed as shown in Table 1. Evaluation was made in the same way. As the result, a very good profile reproducibility was achieved.

Example 13

In Example 1, an electrophotographic photosensitive member was produced in the same manner as that in Example 1 except that the temperature at which the charge transport layer was dried was changed to 120° C. Evaluation was made in the same way. As the result, a slightly low profile reproducibility tended to result. This is considered due to the fact that the temperature of the charge transport layer at the part of pressure contact between the surface of the electrophotographic photosensitive member and the mold during the surface processing was lower than the drying temperature of the charge transport layer.

Example 14

In Example 13, an electrophotographic photosensitive member was produced in the same manner as that in Example 13 except that the temperature at which the charge transport layer was dried was changed to 140° C. and the temperature of the mold at the time of surface processing was changed to 160° C. Evaluation was made in the same way. As the result, a slightly low profile reproducibility tended to result. This is considered due to the fact that the temperature of the charge transport layer at the part of pressure contact between the surface of the electrophotographic photosensitive member and the mold during the surface processing was lower than the drying temperature of the charge transport layer.

Example 15

In Example 1, an electrophotographic photosensitive member was produced in the same manner as that in Example 1 except that the hole transporting compound (2) was changed for a compound (4) shown below, and the surface profile processing was carried out under conditions shown in Table 1. As the result, a good profile reproducibility was achieved.

(4)

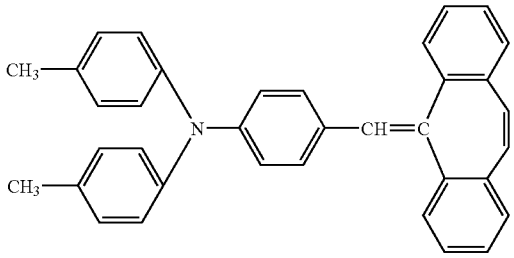

Example 16

In Example 12, an electrophotographic photosensitive member was produced in the same manner as that in Example 12 except that the temperature of the support was controlled to be 45° C. Evaluation was made in the same way. As the result, a very good profile reproducibility was achieved.

Example 17

In Example 16, an electrophotographic photosensitive member was produced in the same manner as that in Example 16 except that the temperature 175° C. of the mold was changed to 200° C. Evaluation was made in the same way. As the result, the surface profile was mostly in a good reproducibility, but a low profile reproducibility was very partly seen. This is considered due to the fact that the temperature of the charge transport layer at the part of pressure contact between the surface of the electrophotographic photosensitive member and the mold during the surface processing was more than the melting point of the charge-transporting material.

Example 18

Figure 11A:
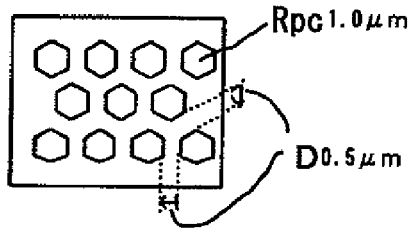
FIG. 11A is a view showing the surface profile of a mold used in Example 15 of the present invention, as viewed from the top of the mold.
Figure 11B:
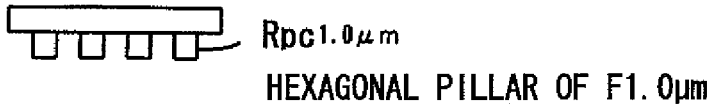
FIG. 11B illustrates the surface profile of the mold shown in FIG. 11A, as viewed from its side.

In Example 16, an electrophotographic photosensitive member was produced in the same manner as that in Example 16 except that the mold used was changed for the mold shown in FIGS. 11A and 11B (surface profile of mold: hexagonal pillars; major-axis diameter Rpc of each pillar: 1.0 μm; distance D between hexagonal pillars: 0.5 μm; height F of each pillar: 1.0 μm). Evaluation was made in the same way. As the result, a very good profile reproducibility was achieved.

Example 19

Figure 12A:
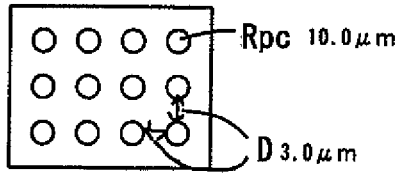
FIG. 12A is a view showing the surface profile of a mold used in Example 16 of the present invention, as viewed from the top of the mold.
Figure 12B:
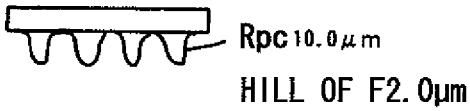
FIG. 12B illustrates the surface profile of the mold shown in FIG. 12A, as viewed from its side.

In Example 16, an electrophotographic photosensitive member was produced in the same manner as that in Example 16 except that the mold used was changed for the mold shown in FIGS. 12A and 12B (surface profile of mold: hills; major-axis diameter Rpc of each hill: 10.0 μm; distance D between hills: 3.0 μm; height F of each hill: 2.0 μm). Evaluation was made in the same way. As the result, a very good profile reproducibility was achieved.

Example 20

Figure 13A:
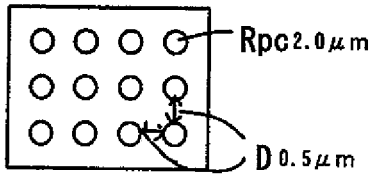
FIG. 13A is a view showing the surface profile of a mold used in Example 17 of the present invention, as viewed from the top of the mold.
Figure 13B:
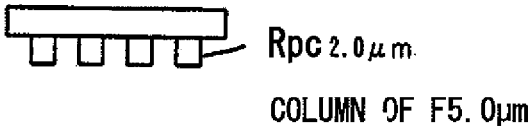
FIG. 13B illustrates the surface profile of the mold shown in FIG. 13A, as viewed from its side.

In Example 16, an electrophotographic photosensitive member was produced in the same manner as that in Example 16 except that the mold used was changed for the mold shown in FIGS. 13A and 13B (surface profile of mold: columns; major-axis diameter Rpc of each column: 2.0 μm; distance D between columns: 0.5 μm; height F of each column: 5.0 μm). Evaluation was made in the same way. As the result, a very good profile reproducibility was achieved.

Example 21

In Example 20, an electrophotographic photosensitive member was produced in the same manner as that in Example 20 except that the temperature at which the charge transport layer was dried was changed to 155° C. Evaluation was made in the same way. As the result, a low profile reproducibility tended to result. This is considered due to the fact that the temperature of the charge transport layer at the part of pressure contact between the surface of the electrophotographic photosensitive member and the mold during the surface processing was lower than the drying temperature of the charge transport layer.

Example 22

Layers up to the charge transport layer were formed in the same manner as that in Example 1 to produce an electrophotographic photosensitive member having no cure type protective layer. Thereafter, the surface profile processing was carried out in the same manner as that in Example 1 except that the temperature of the support was controlled to be 35° C. Evaluation was made in the same way. As the result, compared with Example 1, a profile reproducibility especially in the depth direction was improved. This is presumed to be due to the fact that, in the surface profile processing of the charge transport layer containing a thermoplastic resin and a charge-transporting material, the layer was free from profile changes due to any internal stress ascribable to the protective layer.

Example 23

In Example 22, an electrophotographic photosensitive member was produced in the same manner as that in Example 22 except that the polycarbonate resin (trade name: IUPILON Z400; available from Mitsubishi Engineering-Plastics Corporation) was changed for a resin represented by the following structural formula (5) and that the surface profile processing was carried out under conditions shown in Table 1. Evaluation was made in the same way. As the result, a very good profile reproducibility was achieved.

(5)

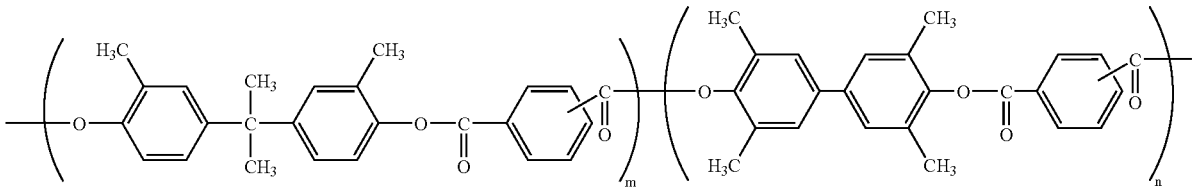

(copolymerization ratio: m:n=7:3; weight average molecular weight: 130,000)

Example 24

In Example 23, an electrophotographic photosensitive member was produced in the same manner as that in Example 23 except that the processing conditions were changed as shown in Table 1. Evaluation was made in the same way. As the result, the surface profile was transferred, but a low profile reproducibility tended to result. This is considered due to the fact that the temperature of the charge transport layer at the part of pressure contact between the surface of the electrophotographic photosensitive member and the mold during the surface processing was lower than the drying temperature of the charge transport layer.

Example 25

In Example 23, an electrophotographic photosensitive member was produced in the same manner as that in Example 23 except that the processing conditions were changed as shown in Table 1. Evaluation was made in the same way. As the result, a much better profile reproducibility in the depth direction than that in Example 23 was achieved. This is considered due to the fact that the temperature of the charge transport layer at the part of pressure contact between the surface of the electrophotographic photosensitive member and the mold during the surface processing was much higher than the drying temperature of the charge transport layer.

Example 26

In Example 23, an electrophotographic photosensitive member was produced in the same manner as that in Example 23 except that the support was not temperature-controlled. Evaluation was made in the same way. As the result, a good profile transfer performance was achieved.

Comparative Example 1

In Example 1, an electrophotographic photosensitive member was produced in the same manner as that in Example 1 except that the holding member inserted to the interior of the support was so temperature-controlled as to be maintained at 85° C. during the surface processing. Evaluation was made in the same way. As the result, the surface profile was seen to have greatly come out of shape because the temperature of the support during the surface processing was higher than the glass transition temperature of the charge transport layer. Thus, no sufficient profile reproducibility was achieved.

Comparative Example 2

In Example 1, an electrophotographic photosensitive member was produced in the same manner as that in Example 1 except that the holding member inserted to the interior of the support was so temperature-controlled as to be maintained at 100° C. during the surface processing. Evaluation was made in the same way. As the result, the surface profile was seen to have greatly come out of shape because the temperature of the support during the surface processing was much higher than the glass transition temperature of the charge transport layer. Thus, no sufficient profile reproducibility was achieved.

Comparative Example 3

In Example 1, an electrophotographic photosensitive member was produced in the same manner as that in Example 1 except that the holding member inserted to the interior of the support was so temperature-controlled as to be maintained at 25° C. during the surface processing and that the processing conditions were changed as shown in Table 1. Evaluation was made in the same way. As the result, the surface profile was unable to be transferred because the temperature of the charge transport layer at the part of pressure contact between the surface of the electrophotographic photosensitive member and the mold during the surface processing was greatly lower than the glass transition temperature of the charge transport layer.

Comparative Example 4

In Example 8, an electrophotographic photosensitive member was produced in the same manner as that in Example 8 except that the processing conditions were changed as shown in Table 1. Evaluation was made in the same way. As the result, no sufficient profile reproducibility was achieved. This is considered due to the fact that the temperature of the support during the surface processing was higher than the glass transition temperature of the charge transport layer.

Comparative Example 5

In Example 22, an electrophotographic photosensitive member was produced in the same manner as that in Example 22 except that the temperature of the support was controlled to be 85° C. Evaluation was made in the same way. As the result, the surface profile was seen to have greatly come out of shape because the temperature of the support during the surface processing was higher than the glass transition temperature of the charge transport layer. Thus, no sufficient profile reproducibility was achieved.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2006-022896, filed Jan. 31, 2006, 2006-022898, filed Jan. 31, 2006, 2006-022899, filed Jan. 31, 2006, and 2007-016218, filed Jan. 26, 2007, which are hereby incorporated by reference herein in their entirety.

What is claimed is:

1. A process for producing an electrophotographic photosensitive member; the process comprising the step of bringing i) the surface of an electrophotographic photosensitive member comprising at least a cylindrical support and a charge transport layer provided thereon and ii) a mold having a fine unevenness surface profile, into pressure contact with each other to transfer the fine unevenness surface profile to the surface of the electrophotographic photosensitive member, wherein;

the mold and the cylindrical support are so temperature-controlled as to be T3<T1<T2 where the glass transition temperature of the charge transport layer is represented by T1(°C.), the temperature of the mold by T2(°C.), and the temperature of the cylindrical support by T3(°C.), and the following relationship is maintained:

T1<T4 where the maximum value of the temperature of the charge transport layer at the part of pressure contact between the surface of the electrophotographic photosensitive member and the mold is represented by T4(°C.), wherein the charge transport layer is formed by coating a solution containing at least a binder resin and a charge-transporting material, and then drying the solution;

T5<T4 where the maximum value of the temperature of the charge transport layer in the step of drying is represented by T5(°C.);

T6<T1 where the maximum value of the temperature of the charge transport layer at the part other than the part of pressure contact between the surface of the electrophotographic photosensitive member and the mold is represented by T6(°C.); and T4<T7 where the melting point of the charge-transporting material is represented by T7 (°C.).

2. The process according to claim 1, wherein a member having a larger heat capacity than the cylindrical support is inserted to the interior of the cylindrical support.

3. The process according to claim 2, wherein the member having a larger heat capacity has a mechanism which controls the temperature of the cylindrical support.

4. The process according to claim 3, wherein the member having a larger heat capacity has a cooling mechanism.

5. The process according to claim 1, wherein the fine unevenness surface profile is continuously transfeffed to the surface of the electrophotographic photosensitive member in its peripheral direction.

6. A process for producing an electrophotographic photosensitive member having a unevenness profile on the surface thereof, comprising a cylindrical support and a charge transport layer provided thereon, the charge transport layer having a glass transition temperature of T1(°C.), the charge transport layer being formed by coating a solution containing at least a binder resin and a charge-transporting material, and then drying the solution, the process comprising a step of bringing a mold having an unevenness surface profile corresponding to the unevenness profile, and having a temperature of T2(°C.), into pressure contact with the peripheral surface of an electrophotographic photosensitive member, and rotating at least one of the mold and the electrophotographic photosensitive member to transfer the unevenness surface profile of the mold to the peripheral surface of the electrophotographic photosensitive member;

wherein the step is carried out while maintaining the relationship represented by the following inequalities: T3<T1<T2, T6<T1, T1<T4, T5<T4, T4<T7, where T3(°C.) represents the temperature of the cylindrical support, T4(°C.) represents the maximum value of the temperature of the charge transport layer at the part of pressure contact between the surface of the electrophotographic photosensitive member and the mold;

T5(°C.) represents the maximum value of the temperature of the charge transport layer in the step of drying;

T6(°C.) represents the maximum value of the temperature of the charge transport layer at the part other than the part of pressure contact between the surface of the electrophotographic photosensitive member and the mold; and T7 (°C.) represents the melting point of the charge-transporting material.

* * * * *